US009684256B2

(12) United States Patent
Araki et al.

(10) Patent No.: US 9,684,256 B2
(45) Date of Patent: Jun. 20, 2017

(54) METHOD FOR PRODUCING TONER BY MANAGING ZETA-POTENTIALS OF PARTICLES

(71) Applicants: KABUSHIKI KAISHA TOSHIBA, Tokyo (JP); TOSHIBA TEC KABUSHIKI KAISHA, Tokyo (JP)

(72) Inventors: Satoshi Araki, Mishima Shizuoka (JP); Maiko Yoshida, Mishima Shizyoka (JP); Taishi Takano, Sunto Shizuoka (JP); Takashi Urabe, Sunto Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/854,300

(22) Filed: Sep. 15, 2015

(65) Prior Publication Data

US 2016/0077453 A1 Mar. 17, 2016

(30) Foreign Application Priority Data

Sep. 16, 2014 (JP) ..... 2014-188288

(51) Int. Cl.

| | |
|---|---|
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0804* (2013.01); *G03G 9/0821* (2013.01); *G03G 9/0823* (2013.01); *G03G 9/08797* (2013.01); *G03G 9/0926* (2013.01)

(58) Field of Classification Search

CPC ..... G03G 9/0804

See application file for complete search history.

(56) References Cited

U.S. PATENT DOCUMENTS 9,354,532 B2 * 5/2016 Yoshida ..... G03G 9/081

FOREIGN PATENT DOCUMENTS

| | | |
|---|---|---|
| JP | 2010-256613 | 11/2010 |
| JP | 4820268 B2 | 11/2011 |

* cited by examiner

*Primary Examiner* — Hoa V Le

(74) *Attorney, Agent, or Firm* — Patterson & Sheridan, LLP

(57) ABSTRACT

A method for producing toner includes adding a liquid containing dispersed resin particles into a liquid containing dispersed colorant particles having a volume average particle size of equal to or greater than 6 μm and having a zeta-potential sign opposite to a zeta-potential sign of the resin particles, until a zeta-potential of aggregates of the colorant particle and the resin particles has a sign opposite to the zeta-potential sign of the colorant particles, adjusting the zeta-potential of the aggregates, such that an absolute value of the zeta-potential of the aggregates is smaller than an absolute value of the zeta-potential of the resin particles by more than 10 mv, and adding a liquid containing dispersed resin particles having a zeta-potential sign that is the same as the sign of the adjusted zeta-potential of the aggregates, into a liquid containing the aggregates.

11 Claims, 4 Drawing Sheets

METHOD FOR PRODUCING TONER BY MANAGING ZETA-POTENTIALS OF PARTICLES

CROSS-REFERENCE TO RELATED APPLICATION

This application is based upon and claims the benefit of priority from Japanese Patent Application No. 2014-188288, filed Sep. 16, 2014, the entire contents of which are incorporated herein by reference.

FIELD

Embodiments described herein relate generally to a method for producing toner, in particular, a method for producing toner by managing zeta-potentials of particles.

BACKGROUND

There are a variety of methods for producing toner. One of the methods is called a pulverizing method. According to the pulverizing method, toner is produced by pulverizing raw particles into smaller particles. The toner produced by the pulverizing method tends to include larger amount of colorant particles that are not covered with or covered very little by binder resin particles and resin particles not including the colorant particle. Such toner may cause toner scattering.

Another method is called an aggregating method. According to the aggregating method, toner is produced by aggregating colorant particles with binder resin particles in a liquid. To produce toner including smaller amount of colorant particles that are not covered with or covered very little by binder resin particles and resin particles not including the colorant particle, using the aggregating method, the toner particles may become larger. Larger toner particles may degrade quality of an image, because the toner particles may not be properly aligned on a surface of a sheet.

The size of the toner particles may be reduced by adjusting zeta-potentials of the colorant particles and the binder resin particles in the aggregating method. However, toner produced by this method may include larger amount of resin particles not including the colorant particle (homo-particles). When an image is formed with toner containing many homo-particles, the toner may not have sufficient coloring property and filming of the toner may occur.

DETAILED DESCRIPTION

An embodiment provides a toner which has a sufficient coloring property and is less likely to cause filming, which is undesirable toner attaching on a photosensitive drum, and a manufacturing method thereof, a toner cartridge, and an image forming apparatus.

In general, according to an embodiment, a method for producing toner includes adding a liquid containing dispersed resin particles into a liquid containing dispersed colorant particles having a volume average particle size of equal to or greater than 6 μm and having a zeta-potential sign opposite to a zeta-potential sign of the resin particles, until a zeta-potential of aggregates of the colorant particle and the resin particles has a sign opposite to the zeta-potential sign of the colorant particles, adjusting the zeta-potential of the aggregates, such that an absolute value of the zeta-potential of the aggregates is smaller than an absolute value of the zeta-potential of the resin particles by more than 10 mv, and adding a liquid containing dispersed resin particles having a zeta-potential sign that is the same as the sign of the adjusted zeta-potential of the aggregates, into a liquid containing the aggregates.

Figure 1:
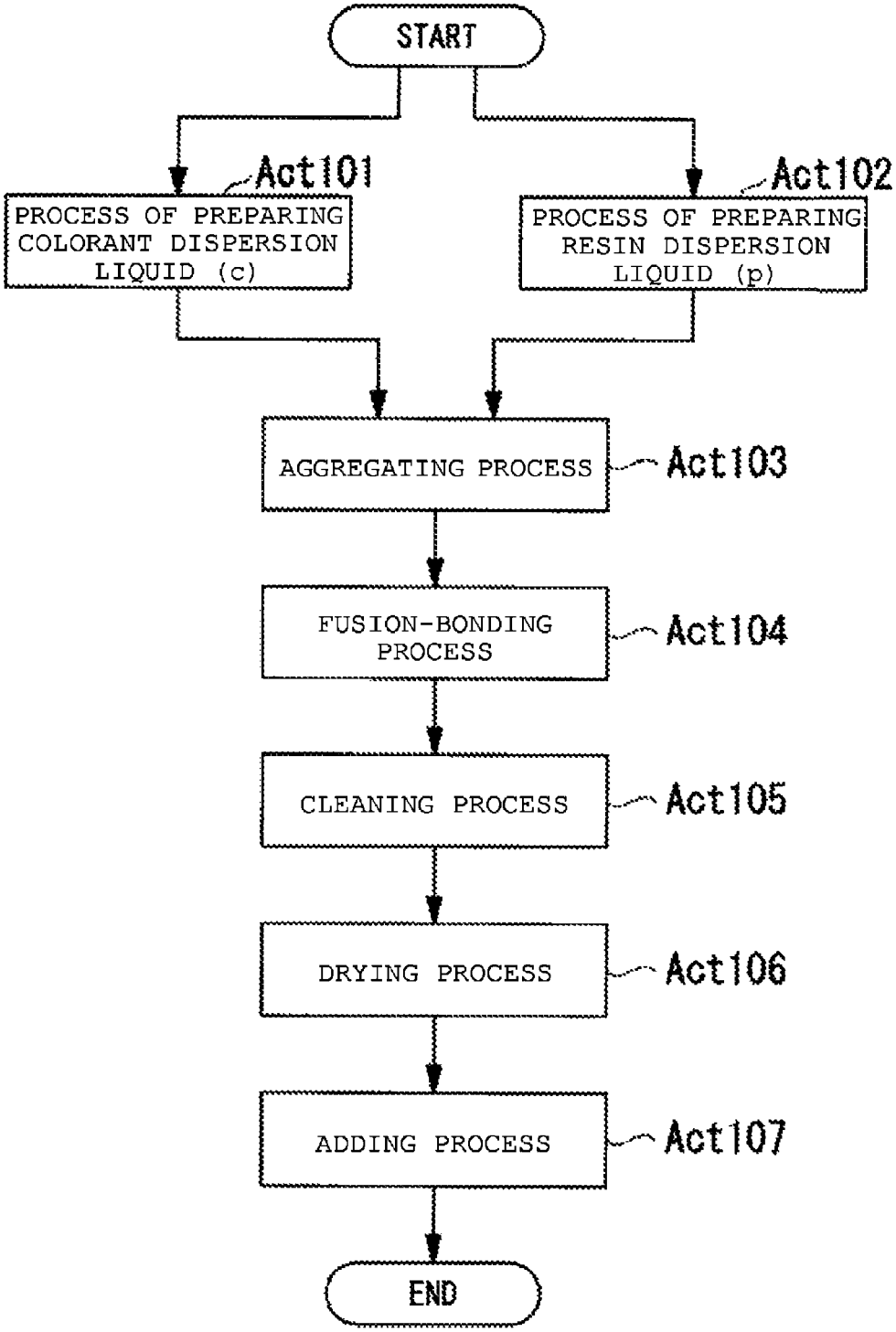
FIG. 1 is a flow chart illustrating a manufacturing method of toner according to an embodiment.

FIG. 1 is a flow chart illustrating a manufacturing method of an electrophotographic toner according to the embodiment.

The embodiment includes a process of preparing a colorant dispersion liquid (c) (Act101), a process of preparing a resin dispersion liquid (p) (Act102)', an aggregating process (Act103), a fusion-bonding process (Act104), a cleaning process (Act105), a drying process (Act106), and an external adding process (Act107).

The process of preparing the colorant dispersion liquid (c) (Act101) will be described below.

The colorant dispersion liquid (c) is a liquid in which particle groups of colorant particles are dispersed.

The particle group of colorant particles has a volume average particle size of equal to or greater than 6 μm, preferably, 6 μm to 100 μm, and more preferably, 10 μm to 100 μm.

When the particle group of colorant particles has a volume average particle size of equal to or greater than 6 μm, a coloring property is sufficiently obtained. A toner which allows easy control in electrophotographic processing is obtained. If the particle group of colorant particles has a volume average particle size of greater than 100 μm, control of developing, transferring, and the like in the electrophotographic processing may be difficult. To control the electrophotographic processing and have the coloring property, the particle group of colorant particles further preferably has a volume average particle size of 10 μm to 60 μm.

In the present disclosure, the volume average particle size of the particle group may be measured using a laser diffraction type particle size distribution measuring apparatus.

The shape of the colorant particle is not particularly limited. Examples of the shape of the colorant particle include a plate shape, a cylindrical shape, a spherical shape, and the like, and among these shapes the preferable shape of the colorant particle is a plate shape. When the colorant particle has a plate shape and an image is formed, a toner tends to have an orientation parallel to a recording medium, and the coloring property is easily obtained.

Examples of a colorant which constitutes the colorant particle include carbon black, an organic or inorganic pigment, and the like.

Examples of the carbon black include acetylene black, furnace black, thermal black, channel black, ketjen black, and the like.

Examples of the organic or inorganic pigment include Fast yellow-G, Benzidine yellow, Indofast orange, Irgazin red, Carmine FB, Permanent Bordeaux FRR, Pigment Orange R, Lithol Red 2G, Lake Red C, Rhodamine FB, Rhodamine B Lake, phthalocyanine blue, Pigment Blue, Brilliant Green B, Phthalocyanine green, Quinacridone, a pearl gloss pigment, and the like. Examples of the pearl gloss pigment include a material in which scale-like mica is covered with a metallic oxide such as a titanium oxide and iron oxide, and the like.

As the colorant, only one type of colorant may be used, or two or more types of colorants may be used together.

Among such colorants, the organic or inorganic pigment is preferably in order to easily obtain the coloring property.

A concentration of the colorant in the colorant dispersion liquid (c) is not particularly limited, and, for example, a ratio of 2 wt % to 15 wt % with respect to the total amount of the colorant dispersion liquid (c) is preferable.

For example, an aqueous medium is used as a dispersion medium in the colorant dispersion liquid (c). Examples of the aqueous medium include water, a mixed solvent of water and an organic solvent, and the like. Among these, the water is preferable.

The colorant dispersion liquid (c) may contain components (optional component (c)) other than the colorant and the dispersion medium. As the optional component (c), for example, a surfactant, a basic compound, and the like are included.

The surfactant acts as a dispersant in the colorant dispersion liquid (c). Examples of the surfactant include an anionic surfactant such as a sulfuric ester salt, sulfonate, a phosphoric ester salt, and soap; a cationic surfactant such as an amine salt, and a quarternary ammonium salt; and a nonionic surfactant of polyethylene glycols, alkylphenol ethylene oxide adducts, polyhydric alcohols or the like. These surfactants may be polymer.

The basic compound acts as a dispersion assistant in the colorant dispersion liquid (c). As the basic compound, an amine compound and the like are included. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, tri-isopropanolamine, isopropanolamine, dimethyl ethanolamine, diethyl ethanolamine, N-butyl diethanolamine, N,N-dimethyl-1,3-diamino propane, N,N-diethyl-1,3-diamino propane, and the like.

The colorant dispersion liquid (c) is prepared by mixing the dispersion medium, the particle group of colorant particles, and the optional component (c) (which is as necessary) with each other, for example.

The colorant particles in the colorant dispersion liquid (c) may have negative zeta-potential, or may have positive zeta-potential. As dispersion of the colorant particles in the colorant dispersion liquid (c) can be stabilized, the zeta-potential of the colorant particles is preferably adjusted so as to be negative.

The zeta-potential of the colorant particles may be adjusted by the surfactants and the basic compound which are described above, for example. A type of the surfactant and a type of the basic compound are determined considering dispersibility of the colorant particles.

For example, the cationic surfactant is used so as to adjust the zeta-potential to be in a positive direction.

For example, the anionic surfactant is used so as to adjust the zeta-potential to be in a negative direction.

The zeta-potential when the colorant particle in the colorant dispersion liquid (c) has both a positive charge and a negative charge may also be adjusted by adjusting pH of the dispersion liquid. The dispersion liquid may have pH which is adjusted by a pH adjusting agent. Examples of the pH adjusting agent include a basic compound such as sodium hydroxide, potassium hydroxide, and an amine compound; an acidic compound such as hydrochloric acid, nitric acid, and sulfuric acid; and the like. The basic compound allows the zeta-potential of the particle having both of the positive charge and the negative charge in the dispersion liquid to be adjusted to be negative. The acidic compound allows the zeta-potential of the particle in the dispersion liquid to be adjusted to be positive.

In the present disclosure, the zeta-potential of the dispersed particles in the dispersion liquid is obtained through the following sequences.

The dispersed particles in the dispersion liquid respectively correspond to colorant particles in the colorant dispersion liquid, resin particles in a resin dispersion liquid, and aggregates in an aggregate dispersion liquid.

Sequence (1): a dispersion liquid having a solid concentration of 50 ppm (mass as a reference) is prepared as a sample by performing dilution with ion exchange water.

Sequence (2): zeta-potential of 100 particles which are dispersed in the sample is measured by a zeta-potential measuring apparatus.

Sequence (3): an average value of the zeta-potential of the 100 particles is obtained and is set as a value of zeta-potential of dispersed particles in the dispersion liquid.

The process of preparing a resin dispersion liquid (p) (Act102) will be described below.

The resin dispersion liquid (p) is a liquid in which particle groups of resin particles are dispersed.

The particle group of resin particles preferably has a volume average particle size of 0.02 μm to 5 μm, and more preferably, 0.05 μm to 2 μm.

When the particle group of resin particles has a volume average particle size of equal to or greater than the preferable lower limit value, it is difficult to form an aggregate (homo-particle) of toner materials other than the colorant. When the particle group of resin particles has a volume average particle size of equal to or less than the upper limit value, a surface of the colorant particle is easily covered with the resin particle.

A ratio (colorant particle/resin particle) of the volume average particle size of the particle group of colorant particles and the volume average particle size of the particle group of resin particles is preferably in a range of 3 to 5000, and more preferably 6 to 2000, further preferably 50 to 1000.

When the ratio (colorant particle/resin particle) of the volume average particle sizes is equal to or greater than the preferable lower limit value, a preferable coloring property is obtained. When the ratio of the volume average particle sizes is equal to or less than the preferable upper limit value, filming is less likely to occur.

The shape of the resin particle is not particularly limited. Examples of the shape of the resin particle include a spherical shape, a cylindrical shape, a plate shape, and the like, and the preferable shape of the resin particle among these shapes is a spherical shape because the spherical shape is likely to aggregate with the colorant particle.

The volume average particle size of the particle group of resin particles, and the shape of the resin particle are controlled by a mechanical shearing device adjusting mechanical shearing power.

Examples of resin which constitute the resin particle includes polyester resin, polystyrene resin, and the like.

As the polyester resin, condensation polymer of polycarboxylic acid and polyalcohol is preferable, and condensation polymer of a dicarboxylic acid component and a diol component is more preferable.

Examples of the dicarboxylic acid component include aromatic dicarboxylic acid, aliphatic carboxylic acid, and the like. Examples of aromatic dicarboxylic acid include terephthalic acid, phthalic acid, isophthalic acid, and the like. Examples of aliphatic carboxylic acid include fumaric acid, maleic acid, succinic acid, adipic acid, sebacic acid, glutaric acid, pimelic acid, oxalic acid, malonic acid, citraconic acid, itaconic acid, and the like.

Examples of the diol component include aliphatic diol, alicyclic diol, ethylene oxide addition, propylene oxide adduct and the like. Examples of aliphatic diol include ethylene glycol, propylene glycol, 1,4-butanediol, 1,3-butanediol, 1,5-pentanediol, 1,6-hexanediol, neo-pentyne glycol, trimethylene glycol, trimethylol propane, pentaerythritol, and the like. Examples of alicyclic diol include 1,4-cyclohexanediol, 1,4-cyclohexanedimethanol, and the like. Examples of ethylene oxide adduct include ethylene oxide adduct of bisphenol A, and the like. Examples of propylene oxide adduct include propylene oxide adduct of bisphenol A, and the like.

As polyester resin, an amorphous substance may be used or a crystalline substance may be used.

As polystyrene resin, copolymer of an aromatic vinyl component and a (meth)acrylic acid ester component is preferable. The (meth)acrylic acid ester corresponds to at least one of acrylic acid ester and methacrylic acid ester.

Examples of the aromatic vinyl component include styrene, α-methylstyrene, o-methylstyrene, p-chlorostyrene. Examples of the (meth)acrylic acid ester component include ethyl acrylate, propyl acrylate, butyl acrylate, 2-ethylhexyl acrylate, butylmethacrylate, ethyl methacrylate, methyl methacrylate, and the like. Among these, butyl acrylate is generally used.

As a polymerization method of the aromatic vinyl component and the (meth)acrylic acid ester component, an emulsion polymerization method is generally used. Polystyrene resin is obtained by, for example, performing radical polymerization on monomers of components in an aqueous phase containing an emulsifier.

A glass transition temperature of the polyester resin and a glass transition temperature of the polystyrene resin are appropriately selected considering a fixation temperature and the like.

A weight-average molecular weight (Mw) of the polyester resin is preferably in a range of 5000 to 30000. Mw of the polystyrene resin is preferably in a range of 10000 to 70000. If Mw of the polyester resin and Mw of the polystyrene resin are less than the preferable lower limit value, heat resistant preservability of the toner is easily degraded. As Mw of each of the resins becomes greater, the fixation temperature becomes higher. When Mw of each of the resins is equal to or less than the preferable upper limit value, an increase of a power consumption amount in fixing processing is easily suppressed.

In the present disclosure, the weight-average molecular weight (Mw) of the resin has a value obtained by performing polystyrene conversion using gel permeation chromatography.

As the resin, only one type of resin may be used, or two or more types of resins may be used together.

Among the resins, the polyester resin is preferable because of low glass transition temperature and low-temperature fixability.

The concentration of the resin in the resin dispersion liquid (p) is appropriately set in accordance with the concentration of the colorant and the like, and is preferably in a range of, for example, 20 wt % to 40 wt % with respect to the total amount of the resin dispersion liquid (p).

As the dispersion medium in the resin dispersion liquid (p), for example, an aqueous medium is used. Examples of the aqueous medium include water, a mixed solvent of water and an organic solvent, and the like, and water is preferable among these media.

The resin dispersion liquid (p) may contain a component (optional component (p)) other than the resin and the dispersion medium. Examples of the optional component (p) include a surfactant, a basic compound, wax, and the like. As the surfactant and the basic compound which are used as the optional component (p), substances similar to the surfactant and the basic compound, which are described as the optional component (c), are included. As the wax used as the optional component (p), a wax which is used as an optional component which will be described below is included.

The resin dispersion liquid (p) is prepared by mixing the dispersion medium, the particle group of resin particles, and the optional component (p) (which is as necessary) with each other, for example. In addition, the resin dispersion liquid (p) containing wax is prepared by mixing a liquid in which the particle groups of resin particles are dispersed, and a liquid (wax dispersion liquid (w)) in which particle groups of wax particles are dispersed.

The resin particles in the resin dispersion liquid (p) may have negative zeta-potential, or may have positive zeta-potential. In order to stabilize dispersion of the resin particles in the resin dispersion liquid (p), the zeta-potential of the resin particles is preferably adjusted so as to be negative.

The zeta-potential of the resin particles may be adjusted using the surfactant, the basic compound, and the pH adjusting agent, for example. Types of the surfactant, the basic compound, and the pH adjusting agent are determined considering dispersibility of the resin particles.

When the resin dispersion liquid (p) is prepared, the mechanical shearing power is applied to disperse substances in the liquid mixture, and thereby the resin is pulverized.

In the present disclosure, pulverization means that the mechanical shearing power is applied to the dispersed substances in the liquid mixture, and thus the particle size of the dispersed substances is smaller than the particle size before the mechanical shearing power is applied.

As the mechanical shearing device which is used in pulverization, for example, a mechanical shearing device in which a medium is not used, or a mechanical shearing device in which a medium is used may be used.

Examples of the mechanical shearing device in which a medium is not used include Ultra-Turrax (product manufactured by IKA Corporation), T.K. Auto Homo Mixer (product manufactured by Primix Corporation), T.K. Pipeline Homo Mixer (product manufactured by Primix Corporation), T.K. Filmix (product manufactured by Primix Corporation), Clearmix (product manufactured by M Technique Co., Ltd.), Clear-SS5 (product manufactured by M Technique Co., Ltd.), Cavitron (product manufactured by Eurotec Co., Ltd.), Fine flow mill (product manufactured by Pacific Machinery & Engineering Co., Ltd), Microfluidizer (product manufactured by Mizuho Industrial CO., LTD.), Ultimaizer (product manufactured by Sugino Machine, LTD.), Nanomizer (product manufactured by Yoshida Kikai Co., Ltd.), Genus PY (product manufactured by Hakusui Tech Co., Ltd.), NANO 3000 (product manufactured by Beryu System Corporation), and the like.

Examples of the mechanical shearing device in which a medium is used include Visco Mill (product manufactured by Aimex CO., Ltd.), Apex Mill (product manufactured by Kotobuki Kogyou. CO., LTD.), Star Mill (product manufactured by Ashizawa Finetech Ltd.), DCP Super Flow (product manufactured by Nippon Eirich Co., Ltd.), MP Mill (product manufactured by Inoue MFG., Inc.), Spike Mill (product manufactured by Inoue MFG., Inc.), Mighty Mill (product manufactured by Inoue MFG., Inc.), SC Mill (product manufactured by Nippon Coke & Engineering CO., LTD.), and the like.

The aggregating process (Act103) will be described below.

Figure 2:
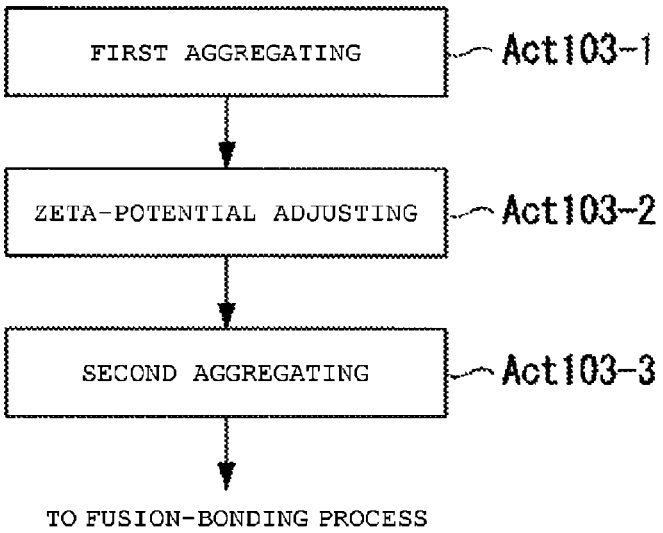
FIG. 2 is a flow chart specifically illustrating an aggregating process in the manufacturing method of the toner.

FIG. 2 illustrates an embodiment of the aggregating process (Act103).

The aggregating process according to the embodiment includes first aggregating (Act103-1), zeta-potential adjusting (Act103-2), and second aggregating (Act103-3).

Figure 3:
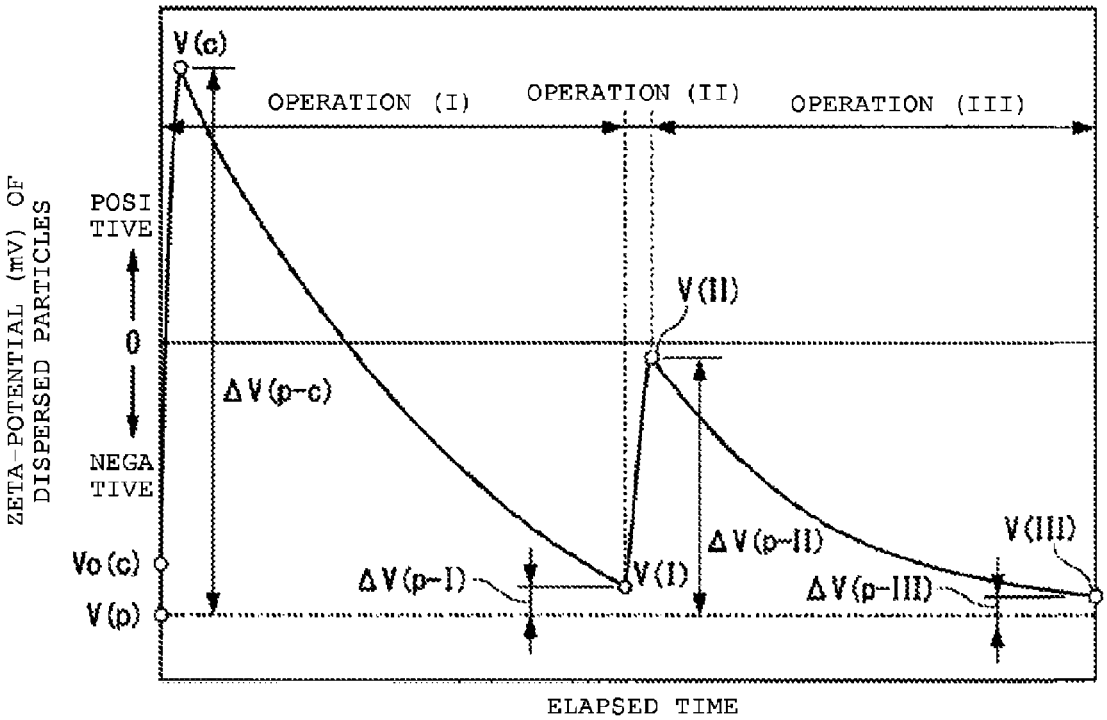
FIG. 3 illustrates a profile of a zeta-potential of dispersed particles in the aggregating process.

FIG. 3 is a graph illustrating a change of the zeta-potential of dispersed particles in the aggregating process (Act103). The dispersed particle refers to the colorant particle in the colorant dispersion liquid, the resin particle of the resin dispersion liquid, and the aggregate of the aggregate dispersion liquid.

A horizontal axis in the graph of FIG. 3 indicates an elapsed time.

In FIG. 3, an operation (I) refers to the first aggregating (Act103-1). An operation (II) refers to the zeta-potential adjusting (Act103-2). An operation (III) refers to the second aggregating (Act103-3).

A vertical axis in the graph of FIG. 3 indicates the zeta-potential (mV) of the dispersed particles in the dispersion liquid.

$V_0(c)$ on the vertical axis indicates the zeta-potential of the colorant particles in the colorant dispersion liquid (c) after the preparation in the process (Act101).

For example, when an organic or inorganic pigment, an anionic surfactant, and an amine compound are used, the zeta-potential $V_0(c)$ is preferably in a range of substantially −70 mV to −10 mV, more preferably, substantially −55 mV to −30 mV. When the zeta-potential $V_0(c)$ is in the preferable range, the dispersion stability of the colorant particles is maintained well.

V(p) on the vertical axis indicates the zeta-potential of the resin particles in the resin dispersion liquid (p).

For example, when a polyester resin, an anionic surfactant, and an amine compound are used, the zeta-potential V(p) is preferably in a range of substantially −70 mV to −10 mV, more preferably, substantially −55 mV to −30 mV. When the zeta-potential V(p) is in the preferable range, the dispersion stability of the resin particles is maintained well.

In the present embodiment, either of V(p) and $V_0(c)$ has negative potential (mV), and V(p) and $V_0(c)$ have a relationship of $v_0(c)>V(p)$.

In FIG. 3, V(c) indicates zeta-potential of the colorant particles in a colorant dispersion liquid (c') after the zeta-potential in the operation (I) is adjusted. V(I) indicates the zeta-potential of the aggregates (a1) in the aggregate dispersion liquid (d1) after the operation (I). V(II) indicates zeta-potential of aggregates (a'1) in an aggregate dispersion liquid (d'1) after the operation (II). V(III) indicates zeta-potential of aggregates (a2) in an aggregate dispersion liquid (d2) after the operation (III).

In FIG. 3, ΔV(p−c) indicates an absolute value of a difference between V(p) and V(c). ΔV(p−I) indicates an absolute value of a difference between V(p) and V(I). Here, a relationship of (an absolute value of V(p))>(an absolute value of V(I)) is satisfied. ΔV(p−II) indicates an absolute value of a difference between V(p) and V(II). ΔV(p−III) indicates an absolute value of a difference between V(p) and V(III).

The zeta-potential of the colorant particles refers to zeta-potential of particles containing the colorant. Examples of the particles containing the colorant include particles which are formed from only the colorant, particles which are formed from the colorant, and a component other than the colorant, and the like. Examples of the component other than the colorant include a dispersant, a dispersion assistant, and the like.

The zeta-potential of the resin particles refers to zeta-potential of particles containing the resin. Examples of the particles containing the resin include particles which are formed from only the resin, particles which are formed from the resin, and a component other than the resin, and the like. Examples of the component other than the resin include the dispersant, the dispersion assistant, and the like.

The zeta-potential of the aggregates refers to zeta-potential of particles containing the aggregates. Examples of the particles containing the aggregates include particles which are formed from the colorant particle and the resin particle, particles which are formed from the colorant particle, the resin particle, and a component other than the colorant particle and the resin particle, and the like. Examples of the component other than the colorant particle and the resin particle include the dispersant, the dispersion assistant, the optional component (coagulant, electrification control agent, wax, and the like), and the like.

The first aggregating (Act103-1) will be described below.

In the first aggregating (operation (I)), the resin dispersion liquid (p) is added to the colorant dispersion liquid (c'). In the colorant dispersion liquid (c'), the particle groups of colorant particles having a certain zeta-potential V(c) are dispersed. In the resin dispersion liquid (p), the particle groups of resin particles having a zeta-potential V(p) with a sign different from that of the zeta-potential V(c) are dispersed.

In the present embodiment, first, the zeta-potential of the colorant particles is adjusted from negative potential ($V_0(c)$) to positive potential (V(c)) such that the zeta-potential of the colorant particles has a sign different from that of the zeta-potential V(p).

A method of adjusting the zeta-potential of the colorant particles from the negative potential ($V_0(c)$) to the positive potential (V(c)) includes, for example, a method of adding a cationic compound in the colorant dispersion liquid (c). Examples of the cationic compound include a cationic surfactant, a pH adjusting agent, and the like.

Examples of the cationic surfactant include a quarternary ammonium salt such as polydiallyl dimethyl ammonium chloride and alkyl benzyl dimethyl ammonium chloride.

Examples of the pH adjusting agent include an acidic compound such as hydrochloric acid, nitric acid, and sulfuric acid.

In FIG. 3, ΔV(p−c) is preferably equal to or greater than a value obtained by adding 10 mv to the absolute value of the zeta-potential V(p), and more preferably, in a range from a value by adding 20 mv to the absolute value of the zeta-potential V(p) to a value by adding 50 mv to the absolute value of the zeta-potential V(p). When ΔV(p−c) is equal to or greater than the preferable lower limit value, cohesion of the colorant particle and the resin particles is enhanced.

In FIG. 3, V(c) is, for example, equal to or greater than +10 mV, and preferably, in a range substantially from +20 mV to +50 mV.

Then, in the present embodiment, the resin dispersion liquid (p) is added to the colorant dispersion liquid (c') which is adjusted to have positive potential (V(c)). Thus, aggregates (a1) are generated by aggregating the colorant particles and the resin particles. The resin dispersion liquid (p) is added to the colorant dispersion liquid (c') until zeta-potential V(a1) of the aggregate (a1) becomes negative potential (that is, has the same sign as the zeta-potential V(p)). After the operation (I), the aggregate dispersion liquid (d1) in which the aggregates (a1) having a zeta-potential with the same sign as the zeta-potential V(p) are dispersed is obtained.

Amount of the resin dispersion liquid (p) added into the colorant dispersion liquid (c') has preferably a value which causes ΔV(p−I) to be equal to or less than 30 mv, more preferably, a value which causes ΔV(p−I) to be equal to or less than 15 mv, and further preferably, a value which causes ΔV(p−I) to be in a range of 1 to 15 mv. When ΔV(p−I) is equal to or less than the preferable upper limit value, a surface of the colorant particle is easily covered with the resin particles. When ΔV(p−I) is equal to or greater than the preferable lower limit value, generation of aggregates (homo-particle) of toner materials other than the colorant is easily suppressed.

In FIG. 3, V(I) is, for example, equal to or less than −10 mV, and preferably, substantially in a range of −50 mV to −20 mV.

When the resin dispersion liquid (p) is added to the colorant dispersion liquid (c'), it is preferable that a small amount of the resin dispersion liquid (p) is added during a long period of time, with respect to the total amount of the colorant dispersion liquid (c'). A predetermined amount of the resin dispersion liquid (p) may be continuously added or may be intermittently added. To completely cover the surface of the colorant particle with the resin particles, it is preferable that the predetermined amount of the resin dispersion liquid (p) is continuously added to the colorant dispersion liquid (c'). When the predetermined amount of the resin dispersion liquid (p) is continuously added to the colorant dispersion liquid (c'), the resin dispersion liquid (p) is preferably added to the colorant dispersion liquid (c') at a constant addition speed. The addition speed is appropriately determined in accordance with a blending amount and the like.

When the resin dispersion liquid (p) is added to the colorant dispersion liquid (c'), an optional component may be added as necessary. Examples of such an optional component include the coagulant, the electrification control agent, and the like.

Examples of the coagulant include a metal salt such as sodium chloride, calcium chloride, calcium nitrate, barium chloride, magnesium chloride, zinc chloride, magnesium sulfate, aluminum chloride, aluminum sulfate, and potassium aluminium sulfate; a non-metal salt such as ammonium chloride and ammonium sulfate; inorganic metal salt polymer such as polyaluminum chloride, polyhydroxide aluminum, and calcium polysulfide; a polymer coagulant such as polymeta acrylic ester, polyacrylic ester, polyacrylamide, and acrylamide-acrylic acid soda copolymer; a coagulant such as polyamine, polydiallyl ammonium halide, polydiallyl dialkyl ammonium halide, melanin formaldehyde condensate, and dicyandiamide; alcohols such as methanol, ethanol, 1-propanol, 2-propanol, 2-methyl-2-propanol, 2-methoxyethanol, 2-ethoxyethanol, and 2-butoxyethanol; acetonitrile; an organic solvent such as 1,4-dioxane; inorganic acid such as hydrochloric acid and nitric acid; and organic acid such as formic acid and acetic acid. Among these substances, from a view of improvement of an aggregation accelerating effect, the non-metal salt is preferable, and ammonium sulfate is more preferable.

Examples of the electrification control agent include an azo compound including metal, a salicylic acid derivative compound including metal, and the like. As the azo compounds including metal, a complex or a complex salt of iron, cobalt, or chrome as the metal, or a mixture thereof is preferable. As the salicylic acid derivative compound including metal, a complex or a complex salt obtained of zirconium, zinc, chrome or boron, or a mixture thereof is preferable.

The zeta-potential adjusting (Act103-2) will be described below.

In the zeta-potential adjusting (operation (II)), an absolute value of the zeta-potential V(a1) is reduced, such that the zeta-potential V(a1) has the same sign as the zeta-potential V(p). In addition, in the zeta-potential adjusting, an absolute value of a difference between the zeta-potential V(a1) and the zeta-potential V(p) is caused to be equal to or greater than 10.

That is, in the present embodiment, the operation (II) causes the zeta-potential to be in a negative range, causes ΔV(p−II) to be equal to or greater than 10, and causes the zeta-potential of the aggregates (a1) in the aggregate dispersion liquid (d1) to be V(II).

Reducing the absolute value of the zeta-potential V(a1) in the range of having the same sign as the zeta-potential V(p) causes generation of aggregates (homo-particle) of toner materials other than the colorant to be suppressed. In addition, the reducing causes toner particles which cause an exposure ratio of the colorant particles to be low, to be easily obtained.

ΔV(p−II) is equal to or greater than 10, preferably, equal to or greater than 20, more preferably, equal to or greater than 25. That is, ΔV(p−II) becomes more preferable as ΔV(p−II) becomes greater in a range of causing V(p) and V(II) to have the same signs. When ΔV(p−II) is equal to or greater than 10, cohesion of the dispersed particle and the resin particles in the aggregate dispersion liquid (d'1) after the operation (II) is enhanced in the second aggregating. Examples of the dispersed particle in the aggregate dispersion liquid (d'1) include the aggregate (a'1), the colorant particle which is not aggregated with the resin particles, and the like.

A method of performing adjustment from V(I) to V(II) is similar to the method of performing adjustment from $V_0$(c) to V(c).

In FIG. 3, V(II) is, for example, equal to or greater than −40 mV, preferably, equal to or greater than −20 mV, and more preferably, substantially −10 mV or more and less than 0 mV. An upper limit value of V(II) is more preferably 0 mV, because the cohesion of the dispersed particles and the resin particles in the aggregate dispersion liquid (d'1) after the operation (II) increases during the second aggregating.

The second aggregating (Act103-3) will be described below.

In the second aggregating (operation (III)), the resin dispersion liquid (p) is added further to the aggregate dispersion liquid (d'1) after the zeta-potential adjusting. Thus, the aggregate (a2) is generated by aggregating the dispersed particles and the resin particles in the aggregate dispersion liquid (d'1). The aggregate dispersion liquid (d2) in which aggregates (a2) are dispersed is obtained.

Amount of the resin dispersion liquid (p) added into the aggregate dispersion liquid (d'1) has preferably a value which causes ΔV(p−III) to be equal to or less than 30 mv, more preferably, a value which causes ΔV(p−III) to be equal to or less than 15 mv, and further preferably, a value which causes ΔV(p−III) to be in a range of 1 to 15 mv. When ΔV(p−III) is equal to or less than the preferable upper limit value, a surface of the colorant particle is completely covered with the resin particles. When ΔV(p−III) is equal to or greater than the preferable lower limit value, generation of the aggregates (homo-particle) of toner materials other than the colorant is easily suppressed.

In FIG. 3, V(III) is, for example, equal to or less than −20 mV, and preferably, in a range of substantially −55 mV to −30 mV.

When the resin dispersion liquid (p) is further added to the aggregate dispersion liquid (d'1), it is preferable that a small amount of the resin dispersion liquid (p) is added during a long period of time, with respect to the total amount of the aggregate dispersion liquid (d'1). A predetermined amount of the resin dispersion liquid (p) may be continuously added or may be intermittently added. As a surface of the dispersed particle is completely covered with the resin particles in the aggregate dispersion liquid (d'1), it is preferable that the predetermined amount of the new resin dispersion liquid (p) is continuously added to the aggregate dispersion liquid (d'1). When the predetermined amount of the new resin dispersion liquid (p) is continuously added to the aggregate dispersion liquid (d'1), the resin dispersion liquid (p) is preferably added to the aggregate dispersion liquid (d'1) at a constant addition speed. The addition speed is appropriately determined in accordance with a blending amount and the like.

When the resin dispersion liquid (p) is further added to the aggregate dispersion liquid (d'1), an optional component such as the coagulant and the electrification control agent may be added as necessary. As the coagulant and the electrification control agent, substances similar to the coagulant and the electrification control agent are included.

The fusion-bonding process (Act104) will be described below.

In the fusion-bonding process of the present embodiment, the aggregates (a2) which are generated in the above-described aggregating process (Act103) are heated. Thus, fusion bonded particles are obtained by performing fusion bonding on the colorant particle and the resin particles which form the aggregate (a2). An operation in the fusion-bonding process may be performed simultaneously with the second aggregating in the above-described aggregating process.

A heating temperature of the aggregates (a2) is appropriately set. The heating temperature is preferable, for example, in a range from a glass transition temperature (Tg) of the resin particles to a temperature of Tg plus 40° C. A heating period is preferably in a range of 2 hours to 10 hours.

The fusion bonded particles after the fusion-bonding process has preferably a volume average particle size of 7 μm to 150 μm, and more preferably, 10 μm to 120 μm.

The cleaning process (Act105) will be described below.

In the cleaning process of the present embodiment, the fusion bonded particles after the above-described fusion-bonding process (Act104) is cleaned. A known cleaning method is used as a cleaning method for the fusion bonded particles. For example, the fusion bonded particles is cleaned by repeating washing and filtering with ion exchange water, and preferably, the process is repeated until conductivity of the liquid becomes equal to or less than 50 μS/cm.

The drying process (Act106) will be described below.

In the drying process of the present embodiment, the toner particles are obtained by drying the fusion bonded particles after the above-described cleaning process. A known drying method is used as a drying method of the fusion bonded particles. An operation for drying the fusion bonded particles is performed using a vacuum dryer, for example. Preferably, the drying process is performed until the moisture content of the fusion bonded particles is equal to less than 1.0 wt %.

The external adding process (Act107) will be described below.

In the external adding process of the present embodiment, the toner particles which are obtained through the above-described drying process are mixed with an external additive, and thereby an electrophotographic toner is obtained.

The external additive is added in order to apply liquidity to the toner or to adjust a charging property, and the like. Examples of the external additive include silica particles, particles of inorganic oxide such as titanium oxide, particles obtained by performing surface processing on these particles with a hydrophobing agent, and the like.

In a manufacturing method of the electrophotographic toner in the present embodiment, colorant particle having a large particle size (volume average particle size of equal to or greater than 6 μm) is used. Using the colorant particle having a large particle size enables a decorated image to be easily obtained.

The aggregating process in the present embodiment includes the first aggregating, the zeta-potential adjusting, and the second aggregating.

According to the first aggregating, the cohesion of the colorant particle and the resin particles increases, and thereby the aggregate (a1) in which the entirety of the colorant particle is covered with the resin particles is obtained.

An electrostatic interaction of the aggregate (a1) and the resin particles becomes stronger through the zeta-potential adjusting, and thus the cohesion between the aggregate (a1) and the resin particles increases. Accordingly, the aggregate (a'1) and the resin particles are aggregated in the second aggregating, and thereby the aggregate (a2) (toner particle including the colorant particle having a low exposure ratio) in which the entirety of the colorant particle is densely covered with the resin particles is obtained. Further, an aggregate in which the colorant particle which is not aggregated with the resin particles in the first aggregating is covered with the resin particle is also obtained. Aggregation of the resin particles is suppressed, and generation of an aggregate (homo-particle) of the toner materials other than the colorant is suppressed.

In the zeta-potential adjusting, the absolute value of the zeta-potential V(a1) is reduced in the range of having the same sign as the zeta-potential V(p). Thus, generation of the homo-particle is also suppressed. If the zeta-potentials have different signs, the homo-particle is likely to be generated. The reason of this is not clear. when the zeta-potentials have different signs, the resin particle which covers the colorant particle in the aggregate (a1) is separated, and thus the separated resin particle easily exists individually. In addition, zeta-potential of the added resin particle fluctuates due to the excessive zeta-potential adjusting agent (surfactant, basic compound, and the like) in the system, and thus an interaction of the resin particles and the dispersed particle becomes weaker.

In the manufacturing method of the electrophotographic toner in the present embodiment, such an aggregating process is included, and thereby a toner in which the particle size (volume average particle size of equal to or greater than 6 μm) and the shape of the colorant particle are held is manufactured. A toner in which the surface of the colorant particle is sufficiently covered with the resin particles is manufactured. A toner containing the homo-particle with a low content ratio is manufactured.

Accordingly, according to the manufacturing method of the electrophotographic toner in the present embodiment, when an image is formed, a toner which leads to sufficient coloring property and prevents the filming is manufactured.

Another embodiment of the aggregating process (Act103) will be described below.

Figure 4:
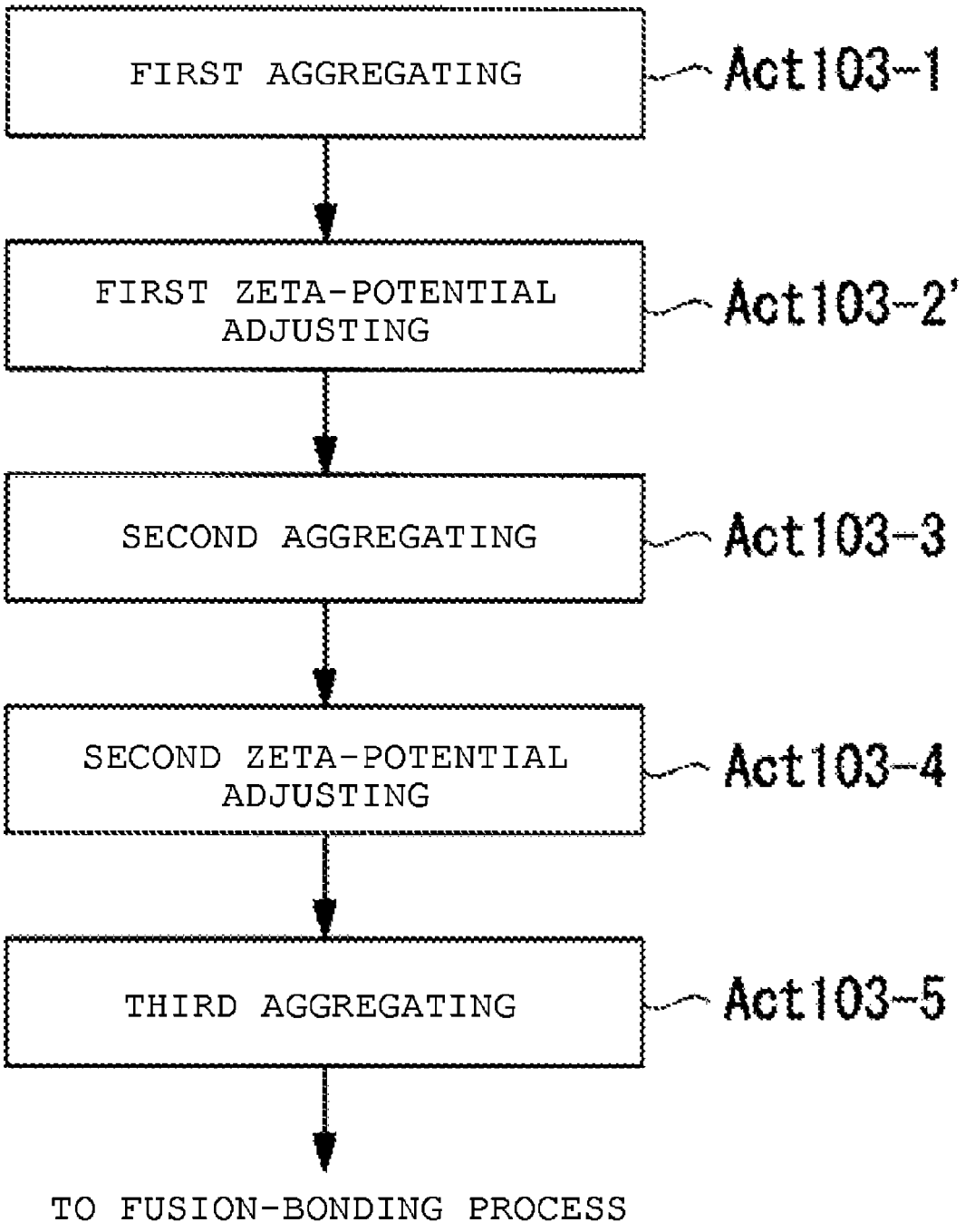
FIG. 4 is a flow chart specifically illustrating the aggregating process according to another embodiment.

In the manufacturing method of the electrophotographic toner in the present embodiment, the aggregating process (Act103) may be carried out as illustrated in FIG. 4.

An aggregating process according to the embodiment illustrated in FIG. 4 includes the first aggregating (Act103-1), first zeta-potential adjusting (Act103-2'), the second aggregating (Act103-3), second zeta-potential adjusting (Act103-4), and third aggregating (Act103-5).

The first aggregating (Act103-1), the first zeta-potential adjusting (Act103-2'), and the second aggregating (Act103-3) are similar to the first aggregating (Act103-1), the zeta-potential adjusting (Act103-2), and the second aggregating (Act103-3) in the aggregating process of the above-described embodiment illustrated in FIG. 2, respectively.

The second zeta-potential adjusting (Act103-4) will be described below.

In the second zeta-potential adjusting (operation (IV)), the absolute value of the zeta-potential V(a2) is reduced in the range of having the same sign as the zeta-potential V(p). An absolute value of a difference between the zeta-potential V(a2) and the zeta-potential V(p) is equal to or greater than 10 mv.

A method of adjusting the zeta-potential in the second zeta-potential adjusting is similar to the method of performing adjustment from V(I) to V(II) in the zeta-potential adjusting (Act103-2).

The third aggregating (Act103-5) will be described below.

In the third aggregating (operation (V)), the resin dispersion liquid (p) is further added to the aggregate dispersion liquid after the operation (IV). Thus, the dispersed particles in the aggregate dispersion liquid after the operation (IV) and the resin particles are aggregated, and thereby an aggregate (a3) is obtained. An aggregate dispersion liquid in which aggregates (a3) are dispersed is obtained.

In the third aggregating, a method of adding the resin dispersion liquid (p) to the aggregate dispersion liquid is similar to the method in the second aggregating.

After the third aggregating, an operation of the fusion-bonding process (Act104) is performed.

According to a manufacturing method of the electrophotographic toner which includes the aggregating process according to the embodiment illustrated in FIG. 4, a toner particle including the colorant particle with a low exposure ratio is easily obtained. Generation of the aggregate (homo-particle) of the toner materials other than the colorant is easily suppressed. For this reason, when an image is formed, the sufficient coloring property is easily obtained and the filming is less likely to occur.

In the aggregating process according to the embodiment illustrated in FIG. 2, the same resin dispersion liquid (p) is used in the first aggregating and the second aggregating. Alternatively, different resin dispersion liquids may be used.

In the aggregating process according to the embodiment illustrated in FIG. 4, the same resin dispersion liquid (p) is used in the first aggregating, the second aggregating, and the third aggregating. However, different resin dispersion liquids may be used.

For example, in the aggregation operations, the resin dispersion liquids which respectively have different types of resin may be used.

In the manufacturing method of the electrophotographic toner in the above-described embodiment, the zeta-potential of the colorant particles is adjusted from a negative value to a positive value in the first aggregating. Alternatively, the zeta-potential of the resin particles may be adjusted from a negative value to a positive value.

In the present embodiment, all of the zeta-potential $V_0(c)$ of the colorant particles and the zeta-potential V(p) of the resin particles are negative. However, the zeta-potential $V_0(c)$ may be positive and the zeta-potential V(p) may be negative. Alternatively, the zeta-potential $V_0(c)$ may be negative and the zeta-potential V(p) may be positive. In these cases, in the first aggregating, an operation of causing the zeta-potential of the colorant particles to have a sign different from the zeta-potential of the resin particles is omitted. Preferably, in the first aggregating, the absolute value (ΔV(p−c)) of the difference between the zeta-potential V(c) of the colorant particles and the zeta-potential V(p) of the resin particles is adjusted to have a value equal to or greater than the absolute value of the zeta-potential V(p) plus 10 mv.

Both of the zeta-potential $V_0(c)$ and the zeta-potential V(p) may be positive. In this case, in the first aggregating, at first, the zeta-potential of the colorant particles has a sign different from the zeta-potential of the resin particles. Preferably, the absolute value (ΔV(p−c)) of the difference between the zeta-potential V(c) of the colorant particles and the zeta-potential V(p) of the resin particles is adjusted to be equal to or greater than the absolute value of the zeta-potential V(p) plus 10 mv.

In the present embodiment, a relationship of $V_0(c)>V(p)$ is satisfied between both of V(p) and $V_0(c)$ which are negative potential (mV). Alternatively, a relationship of $V_0(c)<V(p)$ may be satisfied.

In the manufacturing method of the electrophotographic toner according to the present embodiment, the wax may be blended as the optional component. Blending of the wax causes occurrence of offset due to expressed release properties to be difficult when an image is formed.

Examples of the wax include an aliphatic hydrocarbon-based wax such as low molecular weight polyethylene, low molecular weight polypropylene, polyolefin copolymer, a polyolefin wax, a microcrystallin wax, a paraffin wax, and a Fischer Tropsch Wax; an oxide of aliphatic hydrocarbon-based wax such as an oxidized polyethylene wax, or block copolymer of these substances; a botanical wax such as a candelilla wax, a carnauba wax, a vegetable wax, a jojoba wax, and a rice wax; an animal wax such as a beeswax, a lanoline, and a spermaceti wax; a mineral wax such as ozokerite, ceresin, and petrolatum; waxes which contain fatty acid ester as a main component, such as a palmitate ester wax, a montanoic acid ester wax, and a caster wax; a substance obtained by de-oxidizing a portion or the entirety of fatty acid ester, such as a de-oxidized carnauba wax; saturated straight chain fatty acid such as palmitic acid, stearic acid, montanoic acid, and long chain alkylcarboxylic acids having long chain alkyl; unsaturated fatty acid such as brassidic acid, eleostearic acid, and barinarin acid; saturated alcohol such as stearyl alcohol, eicosyl alcohol, behenyl alcohol, carnaubyl alcohol, ceryl alcohol, melissyl alcohol, and long chain alkylalcohol having long chain alkyl; polyhydric alcohol such as sorbitol; fatty acid amide such as amide linoleate, amide oleate, lauric acid amide; saturated fatty acid bisamide such as methylene-bis-stearic acid amide, ethylene-bis-capric acid amide, ethylenebis lauric acid amide, and hexamethylene bis-stearic acid amide; unsaturated fatty acid amides such as ethylene-bis-oleic acid amide, hexamethylene bis-oleic acid amide, N,N'-dioleoyl adipic acid amide, N,N'-dioleylsebacic acid amide; aromatic bisamide such as M-xylenebis-stearic acid amide, and N,N'-distearyl isophthalic acid amide; a fatty acidic metal salt (substance generally referred to as metal soap) such as calcium stearate, calcium laurate, zinc stearate, and magnesium stearate; a wax obtained by grafting styrene or vinyl monomer of acrylic acid and the like into an aliphatic hydrocarbon wax; a partially esterified substance of fatty acid such as behenic acid monoglyceride, and polyhydric alcohol; and a methyl ester compound having a hydroxy group which is obtained by adding hydrogen to a vegetable oil.

As the wax, only one type of wax may be used, or two or more types of waxes may be used together.

Among the waxes, since the offset can be effectively suppressed, aliphatic hydrocarbon wax and waxes which contain fatty acid ester as a main component are preferable. Among aliphatic hydrocarbon waxes, a paraffin wax is preferable. Among the waxes which contain fatty acid ester as a main component, a fatty acid ester wax is preferable, and a fatty acid ester wax which contains a palmitic acid ester as a main component is more preferable.

For example, a wax dispersion liquid (w) in which particle groups of wax particles are dispersed is used for blending the wax.

The particle group of wax particles has a volume average particle size of preferably 0.02 μm to 1 μm, and more preferably, 0.05 μm to 0.3 μm.

When the volume average particle size of the particle group of wax particles is equal to or greater than the preferable lower limit value, it is difficult to form the aggregate (homo-particle) of the toner material other than the colorant. When the volume average particle size of the particle group of wax particles is equal to or less than the preferable upper limit value, the surface of the colorant particle tends to be covered with the wax particles.

The shape of the wax particle is not particularly limited. Examples of the shape of the wax particle include a spherical shape, a cylindrical shape, a plate shape, and the like, and the preferable shape of the wax particle among these shapes is a spherical shape because the wax particles tend to aggregate with the colorant particles along with the resin particles.

The volume average particle size of the particle group of wax particles, and the shape of the wax particle are controlled by the above-described mechanical shearing device adjusting the mechanical shearing power.

The concentration of the wax in the wax dispersion liquid (w) is appropriately set in accordance with the concentration of the colorant, the type of resin, or the like, and is preferably in a range of, for example, 30 wt % to 50 wt % with respect to the total amount of the wax dispersion liquid (w).

As the dispersion medium in the wax dispersion liquid (w), for example, an aqueous medium is used. Examples of the aqueous medium include water, a mixed solvent of water and an organic solvent, and the like, and water is preferable among these media.

The wax dispersion liquid (w) may contain a component (optional component (w)) other than the wax and the dispersion medium. Examples of the optional component (w) include a surfactant, a basic compound, and the like. The surfactant and the basic compound used as the optional component (w) may include, for example, substances similar to the surfactant and the basic compound which are described as the optional component (c).

The wax dispersion liquid (w) is prepared by mixing the dispersion medium, the wax, and the optional component (w) (which is as necessary) with each other, for example. At this time, mechanical shearing power is applied to the dispersed substances in the liquid mixture, and thereby the wax is pulverized.

Examples of a mechanical shearing device used when pulverization is performed include a device similar to the above-described mechanical shearing device used when the resin is pulverized.

When the wax is blended as an optional component, the wax is blended preferably in the first aggregating of the aggregating process. For example, in the first aggregating, the wax dispersion liquid (w) and the resin dispersion liquid (p) are added to the colorant dispersion liquid (c'). In addition, in the first aggregating, the resin dispersion liquid (p) containing the above-described wax is added to the colorant dispersion liquid (c'). Thus, many wax particles are attached to the colorant particle.

Zeta-potential V(w) of the wax particles in the wax dispersion liquid (w) may be adjusted using the surfactant, the basic compound, and the pH adjusting agent, for example. Types of the surfactant, the basic compound, and the pH adjusting agent are determined considering dispersibility of the wax particles.

An absolute value of the zeta-potential V(w) is preferably greater than the absolute value of the zeta-potential V(p) of the resin particles. When the absolute value of the zeta-potential V(w) is greater than the absolute value of the zeta-potential V(p), the wax particles tend to be more easily attached to the colorant particles.

An absolute value $\Delta V(w-p)$ of a difference between the zeta-potential V(w) and the zeta-potential V(p) is preferably equal to or less than 30, and more preferably in a range of 0 to 20. When $\Delta V(w-p)$ is equal to or less than the preferable upper limit value, the wax particles and the resin particle together are more likely to be attached to the colorant particle. When $\Delta V(w-p)$ is equal to or greater than the preferable lower limit value, the wax particles are more likely to be attached to the colorant particle.

When the fatty acid ester wax, the anionic surfactant, and the amine compound are used, the zeta-potential V(w) is preferably in a range of substantially −70 mV to −10 mV, and more preferably in a range of substantially −55 mV to −30 mV. When the zeta-potential V(w) is in the preferable range, dispersion stability of the wax particles is maintained well.

In the first aggregating, it is preferable that the wax dispersion liquid (w) is added to the colorant dispersion liquid (c') at the same time as the resin dispersion liquid (p) and the wax dispersion liquid (w), or in this order. Adding the wax dispersion liquid (w) in this manner causes much more the resin particles and the wax particles to be attached to the colorant particle. Further, arrangement of the wax in the toner is controlled. Thus, an electrophotographic toner which is less likely to cause a fog or the offset is easily manufactured.

When the resin dispersion liquid (p) and the wax dispersion liquid (w) are added in this order, the wax dispersion liquid (w) may be continuously added subsequently to completion of adding the resin dispersion liquid (p), or may be intermittently added.

When the wax dispersion liquid (w) is added to the colorant dispersion liquid (c'), it is preferable that a small amount of the wax dispersion liquid (w) is added for a long period of time, with respect to the total amount of the colorant dispersion liquid (c'). A predetermined amount of the wax dispersion liquid (w) may be continuously added or may be intermittently added. To attach the wax particles to the surface of the colorant particles, it is preferable that the predetermined amount of the wax dispersion liquid (w) is continuously added. When the wax dispersion liquid (w) is continuously added to the colorant dispersion liquid (c'), it is preferable that the wax dispersion liquid (w) is added to the colorant dispersion liquid (c') at a constant addition speed. The addition speed is appropriately determined in accordance with a blending amount and the like.

An electrophotographic toner according to the present embodiment will be described below.

The electrophotographic toner according to the present embodiment is manufactured by the above-described manufacturing method.

The volume average particle size of the electrophotographic toner according to the present embodiment is preferably in a range of 7 μm to 150 μm, more preferably in a range of 10 μm to 120 μm, and further preferably in a range of 20 μm to 120 μm. When the volume average particle size of the toner is equal to or greater than the preferable lower limit value, the coloring property is more likely to be obtained. When the volume average particle size of the toner is equal to or less than the preferable upper limit value, developing, transferring, and the like in the electrophotographic processing can be easily controlled.

The colorant content in the toner is preferably in a range of 5 wt % to 60 wt % with respect to the total amount of the toner particles (not including the external additive), more preferably in a range of 15 wt % to 55 wt %, and further preferably in a range of 20 wt % to 50 wt %. If the colorant content is less than the preferable lower limit value, the coloring property is less likely to be obtained. If the colorant content exceeds the preferable upper limit value, fixability of the toner and fastness of an image is more likely to be degraded.

The resin content in the toner is preferably in a range of 30 wt % to 90 wt % with respect to the total amount of the toner particles, and more preferably in a range of 35 wt % to 80 wt %. If the resin content is less than the preferable lower limit value, the fixability of the toner and the fastness of an image are less likely to be obtained. If the resin content exceeds the preferable upper limit value, an amount of the colorant is insufficient and thus the coloring property is less likely to be obtained.

When the wax is used as the optional component, the wax content in the toner is preferably in a range of 3 wt % to 30 wt % with respect to the total amount of the toner particles, and more preferably in a range of 5 wt % to 20 wt %. If the wax content is less than the preferable lower limit value, an offset property is insufficient and thus the fixability is less likely to be obtained. If the wax content exceeds the preferable upper limit value, filming tends to occur.

The above-described electrophotographic toner according to the present embodiment is manufactured through the above-described manufacturing method, and thus the surface of the colorant particle is sufficiently covered with the resin particles. The electrophotographic toner has a content ratio of the aggregates (homo-particle) of the toner materials other than the colorant. Consequently, according to the electrophotographic toner of the present embodiment, an image with the sufficient coloring property and reduced occurrence of filming is formed.

The toner according to the present embodiment is suitably used for a non-magnetic single-component developer or a two-component series developer. The toner is stored in, for example, an image forming apparatus such as a multi-function peripheral (MFP), and is used for forming an image on a recording medium using an electrophotographic method. A carrier which is usable when the toner is used in the two-component series developer is not particularly limited, and may be appropriately set by an ordinary person skilled in the related art.

A toner cartridge according to the present embodiment will be described below.

The toner cartridge according to the present embodiment is a container in which the above-described electrophotographic toner according to the present embodiment is stored. A known container is used as the container.

Using the toner cartridge according to the present embodiment for the image forming apparatus enables to more reliably form an image which has the improved coloring property.

The image forming apparatus according to an embodiment will be described below with reference to the accompanying drawings.

The image forming apparatus according to the present embodiment has a main body in which above-described electrophotographic toner is stored. As the main body of the apparatus, a general electrophotographic device is used.

Figure 5:
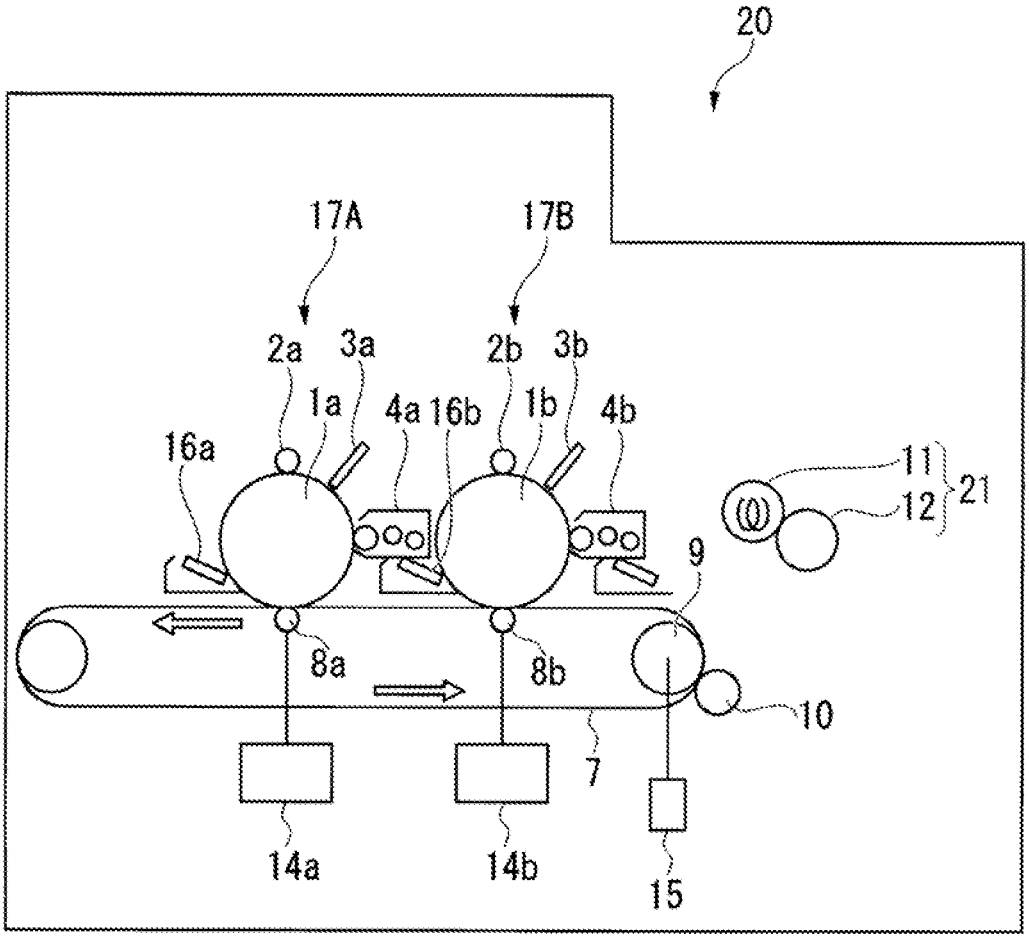
FIG. 5 schematically illustrates an image forming apparatus according to an embodiment.

FIG. 5 illustrates a schematic structure of the image forming apparatus according to the present embodiment.

The image forming apparatus 20 has the main body which includes an intermediate transfer belt 7, a first image forming unit 17A, a second image forming unit 17B, and a fixing device 21. The first image forming unit 17A and the second image forming unit 17B are provided above the intermediate transfer belt 7. The fixing device 21 is provided downstream with respect to the intermediate transfer belt 7 in a medium conveying direction. The first image forming unit 17A is provided downstream with respect to the second image forming unit 17B in a movement direction of the intermediate transfer belt 7, that is, in a proceeding direction of an image forming process. The fixing device 21 is provided downstream with respect to the first image forming unit 17A.

The first image forming unit 17A includes a photoconductive drum 1*a*, a cleaning device 16*a*, a charging device 2*a*, an exposure device 3*a*, a first developing device 4*a*, and a primary transfer roller 8*a*. The cleaning device 16*a*, the charging device 2*a*, the exposure device 3*a*, and the first developing device 4*a* are provided around the photoconductive drum 1*a* in this order in a rotational direction of the photoconductive drum 1*a*. The primary transfer roller 8*a* is provided so as to face the photoconductive drum 1*a* across the intermediate transfer belt 7.

The second image forming unit 17B includes a photoconductive drum 1*b*, a cleaning device 16*b*, a charging device 2*b*, an exposure device 3*b*, a second developing device 4*b*, and a primary transfer roller 8*b*. The cleaning device 16*b*, the charging device 2*b*, the exposure device 3*b*, and the second developing device 4*b* are provided around the photoconductive drum 1*b* in this order in a rotational direction of the photoconductive drum 1*b*. The primary transfer roller 8*b* is provided so as to face the photoconductive drum 1*b* across the intermediate transfer belt 7.

The first developing device 4*a* and the second developing device 4*b* store a developer (single-component developer or two-component series developer) which contains the above-described electrophotographic toner. The toner may be supplied from the toner cartridge (not illustrated).

A primary transfer power source 14*a* is connected to the primary transfer roller 8*a*. A primary transfer power source 14*b* is connected to the primary transfer roller 8*b*.

A secondary transfer roller 9 and a backup roller 10 are disposed downstream with respect to the first image forming unit 17A so as to face each other across the intermediate transfer belt 7. A secondary transfer power source 15 is connected to the secondary transfer roller 9.

The fixing device 21 includes a heat roller 11 and a pressing roller 12 which are disposed so as to face each other.

An image may be formed in a manner as follows, for example, by the image forming apparatus 20.

First, the charging device 2*b* charges the photoconductive drum 1*b* uniformly. Then, the exposure device 3*b* performs exposing and thereby an electrostatic latent image is formed. Then, developing is performed with the toner which is supplied from the second developing device 4*b*, and thereby a second toner image is obtained.

The charging device 2*a* charges the photoconductive drum 1*a* uniformly. Then, the exposure device 3*a* performs exposing based on first image information (second toner image) and thereby an electrostatic latent image is formed. Then, developing is performed with the toner which is supplied from the first developing device 4*a*, and thereby a first toner image is obtained.

The second toner image and the first toner image are transferred to the intermediate transfer belt 7 in this order. The second toner image is transferred by the primary transfer roller 8*b*, and the first toner image is transferred by the primary transfer roller 8*a*.

An image obtained by stacking the second toner image and the first toner image on the intermediate transfer belt 7 in this order is secondarily transferred to a recording medium (not illustrated) between the secondary transfer roller 9 and the backup roller 10. Thus, the image obtained by stacking the second toner image and the first toner image in this order is formed on the recording medium.

The type of colorant which is contained in the toner in the developing device 4*a* and the developing device 4*b* is freely selected. The image forming apparatus 20 illustrated in FIG. 5 includes two developing devices, but may include three developing devices or more in accordance with the type of toner which is used.

In the image forming apparatus 20 illustrated in FIG. 5, the toner image is fixed. However, the image forming apparatus according to the present embodiment is not limited thereto, and may be an ink jet type.

According to the image forming apparatus of the present embodiment, an image which has the improved coloring property and is good is stably formed.

According to at least one embodiment which is described above, the toner is manufactured through the aggregation method with the controlled zeta-potential. Thus, a toner in which the particle size (volume average particle size of equal to or greater than 6 μm) and the shape of the colorant particles are held is manufactured. A toner in which the surface of the colorant particle having a large volume average particle size is sufficiently covered with the resin particles is manufactured. When an image is formed of such a toner, sufficient coloring property is obtained and the filming is less likely to occur.

EXAMPLES

The following examples are for describing an example of the present embodiment. However, this embodiment is not limited to these examples.

A measuring method of the zeta-potential of the dispersed particles will be described below.

Zeta-potential of particles which were dispersed in a dispersion liquid was measured using ZEECOM ZC-3000 (product manufactured by Microtec Co., Ltd.) which was a zeta-potential measuring apparatus.

As a sample, a dispersion liquid was diluted with ion exchange water, and thus a dispersion liquid having a solid concentration of 50 ppm (mass as a reference) was prepared. Then, the zeta-potential of each of 100 particles which were dispersed in the sample is manually measured using the zeta-potential measuring apparatus. Then, an average value of the zeta-potential of these 100 particles was obtained and the obtained average value was set as the zeta-potential of particles which were dispersed in the sample.

A process of preparing a resin dispersion liquid (p1) will be described below.

As a resin, a polyester resin which was condensation polymer of terephthalic acid and ethylene glycols was used.

30 parts by mass of the polyester resin, 3 parts by mass of sodium dodecylbenzenesulfonate as the anionic surfactant, 1 part by mass of triethylamine as the amine compound, and 66 parts by mass of the ion exchange water were mixed with each other using Clearmix (product manufactured by M Technique Co., Ltd.), and thereby a liquid mixture was prepared. The liquid mixture was heated up to 80° C. in Clearmix. Then, mechanical shearing was performed at the number of revolutions of 6000 rpm in Clearmix for 30 minutes. After the mechanical shearing, the liquid mixture was cooled so as to have a normal temperature, and thereby a resin dispersion liquid (p1) was prepared.

The volume average particle size (50% D) of the resin dispersion liquid (p1) was measured using SALD-7000 (product manufactured by Shimadzu Corporation). As a result, the volume average particle size of particle groups of resin particles was 0.16 μm.

The zeta-potential (V(p)) of the resin particles in the resin dispersion liquid (p1) was −48 mV.

Preparing of a wax dispersion liquid (w1) will be described below.

As a wax, a fatty acid ester wax which contains a palmitate ester wax as a main component was used.

40 parts by mass of ester wax, 4 parts by mass of sodium dodecylbenzenesulfonate as the anionic surfactant, 1 part by mass of triethylamine as the amine compound, and 55 parts by mass of the ion exchange water were mixed with each other using Clearmix (product manufactured by M Technique Co., Ltd.), and thereby a liquid mixture was prepared. The liquid mixture was heated up to 80° C. in Clearmix. Then, mechanical shearing was performed at the number of revolutions of 6000 rpm in Clearmix for 30 minutes. After mechanical shearing was ended, the liquid mixture was cooled so as to have a normal temperature, and thereby a wax dispersion liquid (w1) was prepared.

The volume average particle size (50% D) of the wax dispersion liquid (w1) was measured using SALD-7000 (product manufactured by Shimadzu Corporation). As a result, the volume average particle size of particle groups of wax particles was 0.20 μm.

The zeta-potential (V(w)) of the wax particles in the wax dispersion liquid (w1) was −54 mV.

Example 1

A Process of Preparing a Colorant Dispersion Liquid (c1)

7 parts by mass of a cyan pigment as a colorant, 0.1 parts by mass of sodium dodecylbenzenesulfonate as the anionic surfactant, 0.1 parts by mass of triethylamine as the amine compound, and 92.8 parts by mass of the ion exchange water were mixed with each other using Clearmix (product manufactured by M Technique Co., Ltd.), and thereby a liquid mixture was prepared. The temperature of the liquid mixture was adjusted to be 30° C. in Clearmix. Then, mechanical shearing was performed at the number of revolutions of 300 rpm in Clearmix for 10 minutes, and thereby a colorant dispersion liquid (c1) was prepared.

The volume average particle size (50% D) of the colorant dispersion liquid (c1) was measured using SALD-7000 (product manufactured by Shimadzu Corporation). As a result, the volume average particle size of particle groups of colorant particles was 95 μm.

The zeta-potential ($V_0$(c)) of the colorant particles in the colorant dispersion liquid (c1) was −40 mV.

A Process of Preparing a Resin Dispersion Liquid (p2):

35 parts by mass of the resin dispersion liquid (p1), 26 parts by mass of the wax dispersion liquid (w1), and 39 parts by mass of the ion exchange water were put into a flask and stirred. Thus, a resin dispersion liquid (p2) was prepared.

The zeta-potential (V(p)) of the resin particles in the resin dispersion liquid (p2) had a value between −48 mV which is the zeta-potential of the resin particles in the resin dispersion liquid (p1), and −54 mV which was the zeta-potential of the wax particles in the wax dispersion liquid (w1).

Aggregating Process:

150 parts by mass of the colorant dispersion liquid (c1) were put into the flask. Then, 10 parts by mass of a 0.5 wt % polydiallyl dimethyl ammonium chloride solution was added using a dripping funnel, while the colorant dispersion liquid (c1) was stirred. Then, a temperature was increased up to 45° C. and a resultant was used as a colorant dispersion liquid (c'11). At this time, the zeta-potential (V(c)) of the colorant particles in the colorant dispersion liquid (c'11) was +49 mV.

Then, 3 parts by mass of a 10 wt % ammonium sulfate aqueous solution were added to the colorant dispersion liquid (c'11) using a dripping funnel. Then, 30 parts by mass of the resin dispersion liquid (p2) were added to a surface of the stirred liquid at a speed of 0.12 part by mass/min using MasterFlex tubing pump system (product manufactured by Yamato Scientific Co., Ltd., inner diameter of a tube being 0.8 mm) while stirring. Thus, an aggregate dispersion liquid (d11) in which aggregates (a11) obtained by aggregating the colorant particle, the resin particles, and the wax particles were dispersed was obtained. The zeta-potential (V(I)) of the aggregates (a11) in the aggregate dispersion liquid (d11) was −47 mV (first aggregating).

Then, 10 parts by mass of a 0.5 wt % polydiallyl dimethyl ammonium chloride solution were added to the aggregate dispersion liquid (d11) obtained through the first aggregating, using a dripping funnel, and a resultant was used as an aggregate dispersion liquid (d'11). At this time, the zeta-potential (V(II)) of the aggregates (a'11) in the aggregate dispersion liquid (d'11) was −8 mV (zeta-potential adjusting).

Then, 20 parts by mass of the resin dispersion liquid (p1) were added to a stirred liquid surface of the aggregate dispersion liquid (d'11) which was subjected to the zeta-potential adjusting, at a speed of 0.12 part by mass/min using MasterFlex tubing pump system. Thus, an aggregate dispersion liquid (d21) in which aggregates (a21) obtained by aggregating the dispersed particles and the resin particles in the aggregate dispersion liquid (d'11) were dispersed was obtained (second aggregating).

Fusion-Bonding Process:

Then, the temperature of the aggregate dispersion liquid (d21) was increased up to 65° C. Thus, the aggregates (a21) in the aggregate dispersion liquid (d21) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of the fusion bonded particles was 115 μm.

Cleaning Process:

Then, the fusion bonded particles in the dispersion liquid which was subjected to the fusion-bonding process were repeatedly filtered and washed with ion exchange water.

Drying Process:

Then, a vacuum dryer dried the particle group of fusion bonded particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (1) was manufactured. The volume average particle size (50% D) of the toner (1) was measured using SALD-7000 (product manufactured by Shimadzu Corporation). As a result, the volume average particle size of the particle group in the toner (1) was 115 μm.

Example 2

Aggregating Process 300 parts by mass of the colorant dispersion liquid (c1) was put into a flask. Then, 13 parts by mass of the 0.5 wt % polydiallyl dimethyl ammonium chloride solution was added using a dripping funnel, while the colorant dispersion liquid (c1) was stirred. Then, a temperature was increased up to 45° C. and a resultant was used as a colorant dispersion liquid (c'12). At this time, the zeta-potential (V(c)) of the colorant particles in the colorant dispersion liquid (c'12) was +49 mV.

Then, 3 parts by mass of the 10 wt % ammonium sulfate aqueous solution was added to the colorant dispersion liquid (c'12) using a dripping funnel. Then, 30 parts by mass of the resin dispersion liquid (p2) were added to a surface of the stirred liquid at a speed of 0.12 parts by mass/min using MasterFlex tubing pump system. Thus, an aggregate dispersion liquid (d12*a*) in which aggregates (a12*a*) obtained by aggregating the colorant particle, the resin particles, and the wax particles were dispersed was obtained.

Then, 30 parts by mass of the resin dispersion liquid (p1) were added to a surface of the stirred liquid at a speed of 0.12 parts by mass/min using MasterFlex tubing pump system while stirring. Thus, an aggregate dispersion liquid (d12*b*) in which aggregates (a12*b*) obtained by aggregating the aggregate (a12*a*) and the resin particles were dispersed was prepared. The zeta-potential (V(I)) of the aggregates (a12*b*) in the aggregate dispersion liquid (d12*b*) was −47 mV (first aggregating).

Then, 3 parts by mass of the 0.5 wt % polydiallyl dimethyl ammonium chloride solution were added to the aggregate dispersion liquid (d12*b*) obtained through the first aggregating, using a dripping funnel, and a resultant was used as an aggregate dispersion liquid (d'12*b*). At this time, the zeta-potential (V(II)) of aggregates (a'12*b*) in the aggregate dispersion liquid (d'12*b*) was −36 mV (zeta-potential adjusting).

Then, 20 parts by mass of the resin dispersion liquid (p1) were added to a stirred liquid surface of the aggregate dispersion liquid (d'12*b*) which was subjected to the zeta-potential adjusting, at a speed of 0.12 parts by mass/min using MasterFlex tubing pump system. Thus, an aggregate dispersion liquid (d22) in which aggregates (a22) obtained by aggregating the dispersed particles and the resin particles in the aggregate dispersion liquid (d'12*b*) were dispersed was obtained (second aggregating).

Fusion-Bonding Process:

Then, the temperature of the aggregate dispersion liquid (d22) was increased up to 65° C. Thus, the aggregates (a22) in the aggregate dispersion liquid (d22) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 105 μm.

Cleaning Process:

Then, the fusion bonded particles in the dispersion liquid which was subjected to the fusion-bonding process were repeatedly filtered and washed with ion exchange water.

Drying Process:

Then, a vacuum dryer dried the particle group of fusion bonded particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (2) was manufactured. The volume average particle size (50% D) of the toner (2) was measured using SALD-7000 (product manufactured by Shimadzu Corporation). As a result, the volume average particle size of the particle group in the toner (2) was 105 μm.

Example 3

A Process of Preparing a Colorant Dispersion Liquid (c2)

17.5 parts by mass of Iriodin 305 (product manufactured by Merck Corporation, volume average particle size of the pigment being 27 μm) which was a pearl gloss pigment and 232.5 parts by mass of the ion exchange water were put into a flask and mixed with each other. Thus, a colorant dispersion liquid (c2) was prepared. The zeta-potential ($V_0$(c)) of colorant particles in the colorant dispersion liquid (c2) was −36 mV.

Aggregating Process:

Then, 10 parts by mass of the 0.5 wt % polydiallyl dimethyl ammonium chloride solution was added using a dripping funnel, while the colorant dispersion liquid (c2) was stirred. Then, a temperature was increased up to 45° C. and a resultant was used as a colorant dispersion liquid (c'2). At this time, the zeta-potential (V(c)) of colorant particles in the colorant dispersion liquid (c'2) was +46 mV.

Then, 3 parts by mass of the 10 wt % ammonium sulfate aqueous solution were added to the colorant dispersion liquid (c'2) using a dripping funnel. Then, 0.8 parts by mass of the resin dispersion liquid (p1), 13 parts by mass of the wax dispersion liquid (w1), and 20 parts by mass of the resin dispersion liquid (p1) were added to a surface of the stirred liquid at a speed of 0.11 part by mass/min in this order using MasterFlex tubing pump system while stirring. Thus, an aggregate dispersion liquid (d13) in which aggregates (a13) obtained by aggregating the colorant particle, the resin particles, and the wax particles were dispersed was obtained. The zeta-potential (V(I)) of the aggregates (a13) in the aggregate dispersion liquid (d13) was −45 mV (first aggregating).

Then, 10 parts by mass of the 0.5 wt % polydiallyl dimethyl ammonium chloride solution were added to the aggregate dispersion liquid (d13) obtained through the first aggregating, using a dripping funnel, and a resultant was used as an aggregate dispersion liquid (d'13). At this time, the zeta-potential (V(II)) of the aggregates (a'13) in the aggregate dispersion liquid (d'13) was −10 mV (zeta-potential adjusting).

Then, 20 parts by mass of the resin dispersion liquid (p1) were added to a stirred liquid surface of the aggregate dispersion liquid (d'13) which was subjected to the zeta-potential adjusting, at a speed of 0.12 parts by mass/min using MasterFlex tubing pump system. Thus, an aggregate dispersion liquid (d23) in which aggregates (a23) obtained by aggregating the dispersed particles and the resin particles in the aggregate dispersion liquid (d'13) were dispersed was obtained (second aggregating).

Fusion-Bonding Process:

Then, the temperature of the aggregate dispersion liquid (d23) was increased up to 65° C. Thus, the aggregates (a23) in the aggregate dispersion liquid (d23) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of the fusion bonded particles was 40 μm.

Cleaning Process:

Then, the fusion bonded particles in the dispersion liquid which was subjected to the fusion-bonding process were repeatedly filtered and washed with ion exchange water.

Drying Process:

Then, a vacuum dryer dried the particle group of fusion bonded particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (3) was manufactured. The volume average particle size (50% D) of the toner (3) was measured using SALD-7000 (product manufactured by Shimadzu Corporation). As a result, the volume average particle size of the particle group in the toner (3) was 40 μm.

Example 4

A Process of Preparing a Colorant Dispersion Liquid (c3)

21 parts by mass of Iriodin 323 (product manufactured by Merck Corporation, volume average particle size of the pigment being 15 μm) which was a pearl gloss pigment and 279 parts by mass of the ion exchange water were put into a flask and mixed with each other. Thus, a colorant dispersion liquid (c3) was prepared. The zeta-potential ($V_0$(c)) of colorant particles in the colorant dispersion liquid (c3) was −40 mV.

Aggregating Process:

Then, 15 parts by mass of the 0.5 wt % polydiallyl dimethyl ammonium chloride solution were added using a dripping funnel, while the colorant dispersion liquid (c3) was stirred. Then, a temperature was increased up to 45° C. and a resultant was used as a colorant dispersion liquid (c'3). At this time, the zeta-potential (V(c)) of colorant particles in the colorant dispersion liquid (c'3) was +49 mV.

Then, 4 parts by mass of the 10 wt % ammonium sulfate aqueous solution were added to the colorant dispersion liquid (c'3) using a dripping funnel. Then, 3 parts by mass of the resin dispersion liquid (p1), 10 parts by mass of the wax dispersion liquid (w1), and 10 parts by mass of the resin dispersion liquid (p1) were added to a surface of the stirred liquid at a speed of 0.11 parts by mass/min in this order using MasterFlex tubing pump system while stirring. Thus, an aggregate dispersion liquid (d14) in which aggregates (a14) obtained by aggregating the colorant particle, the resin particles, and the wax particles were dispersed was prepared. The zeta-potential (V(I)) of the aggregates (a14) in the aggregate dispersion liquid (d14) was −44 mV (first aggregating).

Then, 10 parts by mass of the 0.5 wt % polydiallyl dimethyl ammonium chloride solution were added to the aggregate dispersion liquid (d14) obtained through the first aggregating, using a dripping funnel, and a resultant was used as an aggregate dispersion liquid (d'14). At this time, the zeta-potential (V(II)) of aggregates (a'14) in the aggregate dispersion liquid (d'14) was −20 mV (zeta-potential adjusting).

Then, 40 parts by mass of the resin dispersion liquid (p1) were added to a stirred liquid surface of the aggregate dispersion liquid (d'14) which was subjected to the zeta-potential adjusting, at a speed of 0.12 parts by mass/min using MasterFlex tubing pump system. Thus, an aggregate dispersion liquid (d24) in which aggregates (a24) obtained by aggregating the dispersed particles and the resin particles in the aggregate dispersion liquid (d'14) were dispersed was obtained (second aggregating).

Fusion-Bonding Process:

Then, the temperature of the aggregate dispersion liquid (d24) was increased up to 65° C. Thus, the aggregates (a24) in the aggregate dispersion liquid (d24) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 20 μm.

Cleaning Process:

Then, the fusion bonded particles in the dispersion liquid which was subjected to the fusion-bonding process were repeatedly filtered and washed with ion exchange water.

Drying Process:

Then, a vacuum dryer dried the particle group of fusion bonded particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (4) was manufactured. The volume average particle size (50% D) of the toner (4) was measured using SALD-7000 (product manufactured by Shimadzu Corporation). As a result, the volume average particle size of the particle group in the toner (4) was 20 μm.

Example 5

A Process of Preparing a Colorant Dispersion Liquid (c4)

10.5 parts by mass of Iriodin 120 (product manufactured by Merck Corporation, volume average particle size of the pigment being 14 μm) which was a pearl gloss pigment and 139.5 parts by mass of the ion exchange water were put into a flask and mixed with each other. Thus, a colorant dispersion liquid (c4) was prepared. The zeta-potential ($V_0$(c)) of colorant particles in the colorant dispersion liquid (c4) was −29 mV.

Aggregating Process:

Then, 8 parts by mass of the 0.5 wt % polydiallyl dimethyl ammonium chloride solution were added using a dripping funnel, while the colorant dispersion liquid (c4) was stirred. Then, a temperature was increased up to 45° C. and a resultant was used as a colorant dispersion liquid (c'4). At this time, the zeta-potential (V(c)) of colorant particles in the colorant dispersion liquid (c'4) was +40 mV.

Then, 4 parts by mass of the 10 wt % ammonium sulfate aqueous solution were added to the colorant dispersion liquid (c'4) using a dripping funnel. Then, 30 parts by mass of the resin dispersion liquid (p2) were added to a surface of the stirred liquid at a speed of 0.11 parts by mass/min in this order using MasterFlex tubing pump system while stirring. Thus, an aggregate dispersion liquid (d15) in which aggregates (a15) obtained by aggregating the colorant particle, the resin particles, and the wax particles were dispersed was obtained. The zeta-potential (V(I)) of the aggregates (a15) in the aggregate dispersion liquid (d15) was −46 mV (first aggregating).

Then, 10 parts by mass of the 0.5 wt % polydiallyl dimethyl ammonium chloride solution were added to the aggregate dispersion liquid (d15) obtained through the first aggregating, using a dripping funnel, and a resultant was used as an aggregate dispersion liquid (d'15). At this time, the zeta-potential (V(II)) of aggregates (a'15) in the aggregate dispersion liquid (d'15) was −13 mV (first zeta-potential adjusting).

Then, 40 parts by mass of the resin dispersion liquid (p1) were added to a stirred liquid surface of the aggregate dispersion liquid (d'15) which was subjected to the first zeta-potential adjusting at a speed of 0.12 parts by mass/min in this order using MasterFlex tubing pump system. Thus, an aggregate dispersion liquid (d25) in which aggregates (a25) obtained by aggregating the dispersed particles and the resin particles in the aggregate dispersion liquid (d'15) were dispersed was obtained. The zeta-potential (V(III)) of the aggregates (a25) in the aggregate dispersion liquid (d25) was −45 mV (second aggregating).

Then, 10 parts by mass of the 0.5 wt % polydiallyl dimethyl ammonium chloride solution were added to the aggregate dispersion liquid (d25) obtained through the second aggregating, using a dripping funnel, and a resultant was used as an aggregate dispersion liquid (d'25). At this time, the zeta-potential (V(IV)) of aggregates (a'25) in the aggregate dispersion liquid (d'25) was −15 mV (second zeta-potential adjusting).

Then, 40 parts by mass of the resin dispersion liquid (p1) were added to a stirred liquid surface of the aggregate dispersion liquid (d'25) which was subjected to the second zeta-potential adjusting, at a speed of 0.12 parts by mass/min using MasterFlex tubing pump system. Thus, an aggregate dispersion liquid (d35) in which aggregates (a35) obtained by aggregating the dispersed particles and the resin particles in the aggregate dispersion liquid (d'25) were dispersed was obtained (third aggregating).

Fusion-Bonding Process:

Then, the temperature of the aggregate dispersion liquid (d35) was increased up to 65° C. Thus, the aggregates (a35) in the aggregate dispersion liquid (d35) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 23 μm.

Cleaning Process:

Then, the fusion bonded particles in the dispersion liquid which was subjected to the fusion-bonding process were repeatedly filtered and washed with ion exchange water.

Drying Process:

Then, a vacuum dryer dried the particle group of fusion bonded particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (5) was manufactured. The volume average particle size (50% D) of the toner (5) was measured using SALD-7000 (product manufactured by Shimadzu Corporation). As a result, the volume average particle size of the particle group in the toner (5) was 23 μm.

Comparative Example 1

Aggregating Process

The first aggregating in Example 1 was performed. Then, the second aggregating was performed without the zeta-potential adjusting.

That is, the first aggregating was performed similarly to in Example 1. The zeta-potential (V(I)) of the aggregates (a11) in the aggregate dispersion liquid (d11) which was obtained in this manner was −47 mV (first aggregating).

Then, 20 parts by mass of the resin dispersion liquid (p1) were added to a stirred liquid surface of the aggregate dispersion liquid (d11) which was subjected to the first aggregating at a speed of 0.12 parts by mass/min. Thus, an aggregate dispersion liquid (d26) in which aggregates of the dispersed particles and the resin particles in the aggregate dispersion liquid (d11) were dispersed was obtained (second aggregating).

Fusion-Bonding Process:

Then, the temperature of the aggregate dispersion liquid (d26) was increased up to 65° C. Thus, the aggregates in the aggregate dispersion liquid (d26) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 107 μm. The dispersion liquid after the temperature was increased was observed by an optical microscope. As a result, it was found that many aggregates (homo-particles) of the toner materials other than the colorant existed.

Cleaning Process:

Then, the dispersed particles in the dispersion liquid which was subjected to the fusion-bonding process were repeatedly filtered and washed with ion exchange water.

Drying Process:

Then, a vacuum dryer dried the particle group of dispersed particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (6) was manufactured. The volume average particle size (50% D) of the toner (6) was measured using SALD-7000 (product manufactured by Shimadzu Corporation). As a result, the volume average particle size of the particle group in the toner (6) was 107 μm.

Comparative Example 2

Aggregating Process

An addition amount of the 0.5 wt % polydiallyl dimethyl ammonium chloride solution in the zeta-potential adjusting of Example 1 was changed to 20 parts by mass (at this time, the zeta-potential (V(II)) of the dispersed particles in the aggregate dispersion liquid was +5 mV). Except for this change, processes were performed similarly to the first aggregating, the zeta-potential adjusting, and the second aggregating in Example 1. Thus, an aggregate dispersion liquid (d27) in which aggregates were dispersed was prepared.

Fusion-Bonding Process:

Then, the temperature of the aggregate dispersion liquid (d27) was increased up to 65° C. Thus, the aggregates in the aggregate dispersion liquid (d27) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 103 μm. The dispersion liquid after the temperature was increased was observed by an optical microscope. As a result, it was found that many aggregates (homo-particles) of the toner materials other than the colorant existed.

Cleaning Process:

Then, the dispersed particles in the dispersion liquid which was subjected to the fusion-bonding process were repeatedly filtered and washed with ion exchange water.

Drying Process:

Then, a vacuum dryer dried the particle group of dispersed particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (7) was manufactured. The volume average particle size (50% D) of the toner (7) was measured using SALD-7000 (product manufactured by Shimadzu Corporation). As a result, the volume average particle size of the particle group in the toner (7) was 103 μm.

Comparative Example 3

Aggregating Process

An addition amount of the 0.5 wt % polydiallyl dimethyl ammonium chloride solution in the zeta-potential adjusting of Example 3 was changed to 1 part by mass (at this time, the zeta-potential (V(II)) of the dispersed particles in the aggregate dispersion liquid was −42 mV). Except for this change, processes similar to the first aggregating, the zeta-potential adjusting, and the second aggregating in Example 3 were performed. Thus, an aggregate dispersion liquid (d28) in which aggregates were dispersed was prepared.

Fusion-Bonding Process:

Then, the temperature of the aggregate dispersion liquid (d28) was increased up to 65° C. Thus, the aggregates in the aggregate dispersion liquid (d28) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 37 μm. The dispersion liquid after the temperature was increased was observed by an optical microscope. As a result, it was found that many aggregates (homo-particles) of the toner materials other than the colorant existed.

Cleaning Process:

Then, the dispersed particles in the dispersion liquid which was subjected to the fusion-bonding process were repeatedly filtered and washed with ion exchange water.

Drying Process:

Then, a vacuum dryer dried the particle group of dispersed particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (8) was manufactured. The volume average particle size (50% D) of the toner (8) was measured using SALD-7000 (product manufactured by Shimadzu Corporation). As a result, the volume average particle size of the particle group in the toner (8) was 37 μm.

Comparative Example 4

Aggregating Process

An addition amount of the 0.5 wt % polydiallyl dimethyl ammonium chloride solution in the zeta-potential adjusting of Example 4 was changed to 20 parts by mass (at this time, the zeta-potential (V(II)) of the dispersed particles in the aggregate dispersion liquid was +2 mV). Except for this change, processes were performed similarly to the first aggregating, the zeta-potential adjusting, and the second aggregating in Example 4. Thus, an aggregate dispersion liquid (d29) in which aggregates were dispersed was prepared.

Fusion-Bonding Process:

Then, the temperature of the aggregate dispersion liquid (d29) was increased up to 65° C. Thus, the aggregates in the aggregate dispersion liquid (d29) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 37 μm. The dispersion liquid after the temperature was increased was observed by an optical microscope. As a result, it was found that many aggregates (homo-particles) of the toner materials other than the colorant existed.

Cleaning Process:

Then, the dispersed particles in the dispersion liquid which was subjected to the fusion-bonding process were repeatedly filtered and washed with ion exchange water.

Drying Process:

Then, a vacuum dryer dried the particle group of dispersed particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (9) was manufactured. The volume average particle size (50% D) of the toner (9) was measured using SALD-7000 (product manufactured by Shimadzu Corporation). As a result, the volume average particle size of the particle group in the toner (9) was 37 μm.

Comparative Example 5

Aggregating Process

The zeta-potential adjusting of the colorant dispersion liquid (c1) in Example 1 was not performed (the zeta-potential of the colorant particles in the colorant dispersion liquid (c1) was held to be −40 mV). In the zeta-potential adjusting, an addition amount of the 0.5 wt % polydiallyl dimethyl ammonium chloride solution was changed to be 20 parts by mass. Except for these changes, processes were performed similarly to the first aggregating, the zeta-potential adjusting, and the second aggregating in Example 1. Thus, an aggregate dispersion liquid (d20) in which aggregates were dispersed was prepared.

The zeta-potential (V(I)) of aggregate particles in the aggregate dispersion liquid which was obtained through the first aggregating was −48 mV. The zeta-potential (V(II)) of aggregate particles in the aggregate dispersion liquid which was subjected to the zeta-potential adjusting was −8 mV.

Fusion-Bonding Process:

Then, the temperature of the aggregate dispersion liquid (d20) was increased up to 65° C. Thus, the aggregates in the aggregate dispersion liquid (d20) were fusion-bonded, and thereby fusion bonded particles were prepared.

The volume average particle size (50% D) of the dispersion liquid in which the fusion bonded particles after the temperature was increased were dispersed was measured using SALD-7000 (product manufactured by Shimadzu Corporation). As a result, the volume average particle size of particle groups of fusion bonded particles was 37 μm. The dispersion liquid after the temperature was increased was observed by an optical microscope. As a result, it was found that many aggregates (homo-particles) of the toner materials other than the colorant, and many colorant particles which were not covered with the toner materials (resin particles and wax particles) existed.

Cleaning Process:

Then, the dispersed particles in the dispersion liquid which was subjected to the fusion-bonding process were repeatedly filtered and washed with ion exchange water.

Drying Process:

Then, a vacuum dryer dried the particle group of dispersed particles which were separated by the last filtering, and thereby the particle group of toner particles was prepared.

External Adding Process:

Then, the particle group of toner particles, 2 parts by mass of hydrophobic silica, and 0.5 parts by mass of titanium oxide were mixed in a Henschel mixer, and thereby a toner (10) was manufactured. The volume average particle size (50% D) of the toner (10) was measured using SALD-7000 (product manufactured by Shimadzu Corporation). As a result, the volume average particle size of the particle group in the toner (10) was 37 μm.

Table 1 illustrates a composition of the toner which was manufactured in each example.

TABLE 1

| | | Toner composition | | | | |
|---|---|---|---|---|---|---|
| | | Toner particles | | | External additive | |
| | Colarant | Colarant (part by mass) | Resin (part by mass) | Wax (part by mass) | Hydrophobing silica (part by mass) | Titanium oxide (part by mass) |
| Example 1 | Cyan pigment | 33 | 57 | 10 | 2 | 0.5 |
| Example 2 | Cyan pigment | 52 | 43 | 5 | 2 | 0.5 |
| Example 3 | Iriodin 305 | 46 | 40 | 14 | 2 | 0.5 |
| Example 4 | Iriodin 323 | 49 | 37 | 14 | 2 | 0.5 |
| Example 5 | Iriodin 120 | 25 | 71 | 4 | 2 | 0.5 |
| Comparative Example 1 | Cyan pigment | 33 | 57 | 10 | 2 | 0.5 |
| Comparative Example 2 | Cyan pigment | 33 | 57 | 10 | 2 | 0.5 |
| Comparative Example 3 | Iriodin 305 | 46 | 40 | 14 | 2 | 0.5 |
| Comparative Example 4 | Iriodin 323 | 46 | 40 | 14 | 2 | 0.5 |
| Comparative Example 5 | Cyan pigment | 33 | 57 | 10 | 2 | 0.5 |

Evaluation of the coloring property will be described below.

The toner which was manufactured in each example, and a ferrite carrier which was covered with a silicone resin were mixed with each other, and thereby a developer was prepared. At this time, the concentration of the ferrite carrier in the developer was set such that the concentration with respect to the toner was 8 wt %.

The fixation temperature was set to 150° C. and a solid image was printed on black paper using an electrophotographic combined machine (product manufactured by Toshiba Tec Corporation, e-studio 2050c) in which the developer was stored. Then, the coloring property was evaluated with eyes. An evaluation reference of the coloring property is as follows.

Evaluation Reference of Coloring Property

A: a solid image has no non-uniformity and sufficient coloring property.

B: a solid image has some non-uniformity and sufficient coloring property.

C: a solid image has much non-uniformity and coloring property of an extent of being slightly felt.

D: a solid image has significant non-uniformity and coloring property which is hardly felt.

Evaluation of the offset property will be described below.

In the evaluation of the coloring property, the solid image was printed on the black paper and then blank paper was fed to the electrophotographic combined machine. Then, the solid image which was printed on the black paper and the blank paper which was fed to the electrophotographic combined machine were observed with eyes. An evaluation reference of the offset property is as follows.

A: none of the solid image and the blank paper has a trace of the offset.

B: the offset is not found in the solid image, and fixation of one or two points of the offset portion on the blank paper is viewed. However, there is no practical problem.

C: the offset is not found in the solid image. Fixation of several points of the offset portion on the blank paper is viewed, but there is no practical problem in practice.

D: the offset is not found in the solid image. Fixation of some offset portions on the blank paper is viewed and there is a practical problem.

E: the offset on the solid image is found.

Evaluation of the filming will be described below.

A developer similar to the developer which was prepared in the evaluation of the coloring property was prepared.

10000 pieces of a 6% chart was continuously printed using an electrophotographic combined machine (product manufactured by Toshiba Tec Corporation, e-studio 2050c) in which the developer was stored. Then, sequentially solid images were printed on black paper. The solid images and the surface of a photoconductive drum were observed, and thus the filming was evaluated. An evaluation reference of the filming is as follows.

A: none of the image and the surface of the photoconductive drum has filming.

B: the filming does not occur on the image. There is one or two points of the filming on the surface of the photoconductive drum, but there is no practical problem.

C: a plurality of points of the filming, or omission or a line which is considered to occur due to one or two pieces of filming is found on the image. There is a practical problem.

D: omission or a line which is considered to occur due to much filming is viewed on the entire surface of the image. There is a big problem.

Table 2 illustrates evaluation results of the coloring property, the offset property, and the filming regarding the toner which was manufactured in each example.

TABLE 2

| | Zeta-potential (mV) of dispersed particles | | | | | | | Volume | Evaluation | | |
|---|---|---|---|---|---|---|---|---|---|---|---|
| | First aggregating | | | After zeta-potential adjusting | | After second aggregating | After second zeta-potential adjusting | average particle size of toner (μm) | Coloring property | Filming | Offset property |
| | $V_0(c)$ | V(c) | V(I) | V(II) | ΔV(p-II) | V(III) | V(IV) | | | | |
| Example 1 | −40 | +49 | −47 | −8 | 40 | | | 115 | A | B | A |
| Example 2 | −40 | +49 | −47 | −36 | 12 | | | 105 | A | A | A |
| Example 3 | −36 | +46 | −45 | −10 | 38 | | | 40 | A | B | B |
| Example 4 | −40 | +49 | −44 | −20 | 28 | | | 20 | B | A | B |
| Example 5 | −29 | +40 | −46 | −13 | 35 | −45 | −15 | 23 | B | A | B |
| Comparative Example 1 | −40 | +49 | −47 | | | | | 107 | C | B | C |
| Comparative Example 2 | −40 | +49 | −47 | +5 | 53 | | | 103 | C | B | D |
| Comparative Example 3 | −36 | +46 | −45 | −42 | 6 | | | 37 | C | C | C |
| Comparative Example 4 | −40 | +49 | −44 | +2 | 50 | | | 37 | D | B | D |
| Comparative Example 5 | −40 | | −48 | −8 | 40 | | | 37 | C | D | D |

In Examples 1 to 5 obtained by applying the present embodiment, both of the coloring property and the filming had good evaluation results. The offset property also had a good evaluation result.

To the contrary, in Comparative Examples 1 to 5, at least one of the coloring property and the filming had a poor evaluation result.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method for producing toner, comprising:

adding a liquid containing dispersed resin particles into a liquid containing dispersed colorant particles having a volume average particle size of equal to or greater than 6 μm and having a zeta-potential sign opposite to a zeta-potential sign of the resin particles, until a zeta-potential of aggregates of the colorant particle and the resin particles has a sign opposite to the zeta-potential sign of the colorant particles;

adjusting the zeta-potential of the aggregates, such that an absolute value of the zeta-potential of the aggregates is smaller than an absolute value of the zeta-potential of the resin particles by more than 10 mv; and adding a liquid containing dispersed resin particles having a zeta-potential sign that is the same as the sign of the adjusted zeta-potential of the aggregates, into a liquid containing the aggregates.

2. The method according to claim 1, wherein a volume average particle size of the colorant particles is equal to or greater than 6 μm and equal to or smaller than 100 μm.

3. The method according to claim 1, wherein a mass concentration of the colorant particles is equal to or greater than 2% and equal to or smaller than 15%.

4. The method according to claim 1, wherein a volume average particle size of the resin particles in the liquid added to the liquid containing the dispersed colorant particles is equal to or greater than 0.02 μm and equal to or smaller than 5 μm.

5. The method according to claim 1, wherein a mass concentration of the resin particles in the liquid added to the liquid containing the dispersed colorant particles is equal to or greater than 20% and equal to or smaller than 40%.

6. The method according to claim 1, wherein a ratio of a volume average particle size of the colorant particles with respect to a volume average particle size of the resin particles in the liquid added to the liquid containing the dispersed colorant particles is equal to or greater than 3 and equal to or smaller than 5000.

7. The method according to claim 1, wherein the zeta-potential sign of the colorant particles is positive.

8. The method according to claim 1, wherein the zeta-potential sign of the colorant particles is negative.

9. The method according to claim 1, further comprising:

repeating the adjusting of the zeta-potential of the aggregates and the adding of the liquid containing the disposed resin into the liquid containing the aggregates.

10. The method according to claim 1, further comprising:

heating the aggregates after the adding of the liquid containing the dispersed resin particles; and extracting the aggregates from the liquid.

11. The method according to claim 1, wherein the zeta-potential of the aggregates is adjusted by adding a surfactant or a pH adjusting agent into the liquid containing the aggregates.

* * * * *